US005978781A

United States Patent [19]

Sansone

[11] Patent Number: 5,978,781

[45] Date of Patent: Nov. 2, 1999

[54] DIGITAL PRINTING, METERING, AND RECORDING OF OTHER POST SERVICES ON THE FACE OF A MAIL PIECE

[75] Inventor: Ronald P. Sansone, Weston, Conn.

[73] Assignee: Pitney Bowes Inc., Stamford, Conn.

[21] Appl. No.: 08/848,425

[22] Filed: May 8, 1997

[51] Int. Cl.[6] ..... G07B 17/00

[52] U.S. Cl. ..... 705/408; 101/71; 283/71; 705/402

[58] Field of Search ..... 101/71; 283/71; 705/400, 402, 406, 407, 408, 410

[56] References Cited

U.S. PATENT DOCUMENTS

| | | | |
|---|---|---|---|
| 3,290,491 | 12/1966 | Wahlberg | 705/406 |
| 4,296,476 | 10/1981 | Mayer et al. | 364/900 |
| 4,471,464 | 9/1984 | Mayer et al. | 364/900 |
| 4,638,439 | 1/1987 | Daniels | 705/407 |
| 4,831,555 | 5/1989 | Sansone et al. | 395/113 |
| 4,903,139 | 2/1990 | Minter | 358/296 |
| 5,051,925 | 9/1991 | Kadono et al. | 364/519 |
| 5,142,614 | 8/1992 | Scheider et al. | 395/115 |
| 5,150,456 | 9/1992 | Wu et al. | 395/114 |
| 5,295,196 | 3/1994 | Raterman et al. | 382/7 |
| 5,319,562 | 6/1994 | Whitehouse | 364/464.03 |
| 5,357,604 | 10/1994 | San et al. | 395/162 |
| 5,363,202 | 11/1994 | Udagawa et al. | 358/501 |
| 5,388,841 | 2/1995 | San et al. | 273/435 |
| 5,410,641 | 4/1995 | Wakabayashi et al. | 395/112 |
| 5,448,641 | 9/1995 | Pintsov et al. | 380/51 |
| 5,501,393 | 3/1996 | Walz | 229/92.8 |
| 5,699,258 | 12/1997 | Thiel | 705/409 |
| 5,717,596 | 2/1998 | Bernard et al. | 705/404 |
| 5,726,894 | 3/1998 | Sansone | 705/408 |
| 5,737,729 | 4/1998 | Denman | 705/401 |

OTHER PUBLICATIONS

PostMaster Software, Inc. (No date).

*Primary Examiner*—Edward R. Cosimano
*Attorney, Agent, or Firm*—Ronald Reichman; Melvin J. Scolnick

[57] ABSTRACT

A inexpensive and time saving method and system for reducing the use of gummed service stickers and the completion by hand of special forms for specialty mail is disclosed. This invention also reduces the amount of trips that have to be made to the post. The foregoing may be accomplished by replacing the standard (fixed) graphic cartridge that is normally supplied with a standard digital postage meter with an addressable "ram" image cartridge. The addressable ram image cartridge may also be linked to a personal computer, where a program would allow the user to request specialty mail services. Once the desired service (services) are selected, the required postal graphic images are downloaded into the ram cartridge. Next, postal payment, if any, is totaled and the additional postal value is totaled and passed to the postal meter vault for totaling and printing in an accountable way. Finally, the personal computer meter or postage meter cycles normally first printing the indicia and then the graphics and bar codes as specified by each postal service that was selected by the user.

18 Claims, 22 Drawing Sheets

POSTAL DATA CENTER COMPUTER
70
MODEM(s)
69
40
42
FUNDS DB
66
GRAPHIC DB
67
RATE DB
68
POSTAGE METER MANUFACTURER DATA CENTER COMPUTER
65
MODEM(s)
64
41
GRAPHICS REGISTRY COMPUTER
90
REGISTERED IMAGES DATABASE
91
USER COMPUTER WITH MAIL SOFTWARE
50
MODEM
62
USER PRINTER
60
POSTAL FORMS
61
ADDRESSABLE RAM MEMORY
59
58
52
CONTROLLER
57
USER I/O
53
PRINT
56
ACCOUNTING AND GRAPHICS
55
FUNDS VAULT
54
USER PRINTER
51
11
12
13
14
20
33

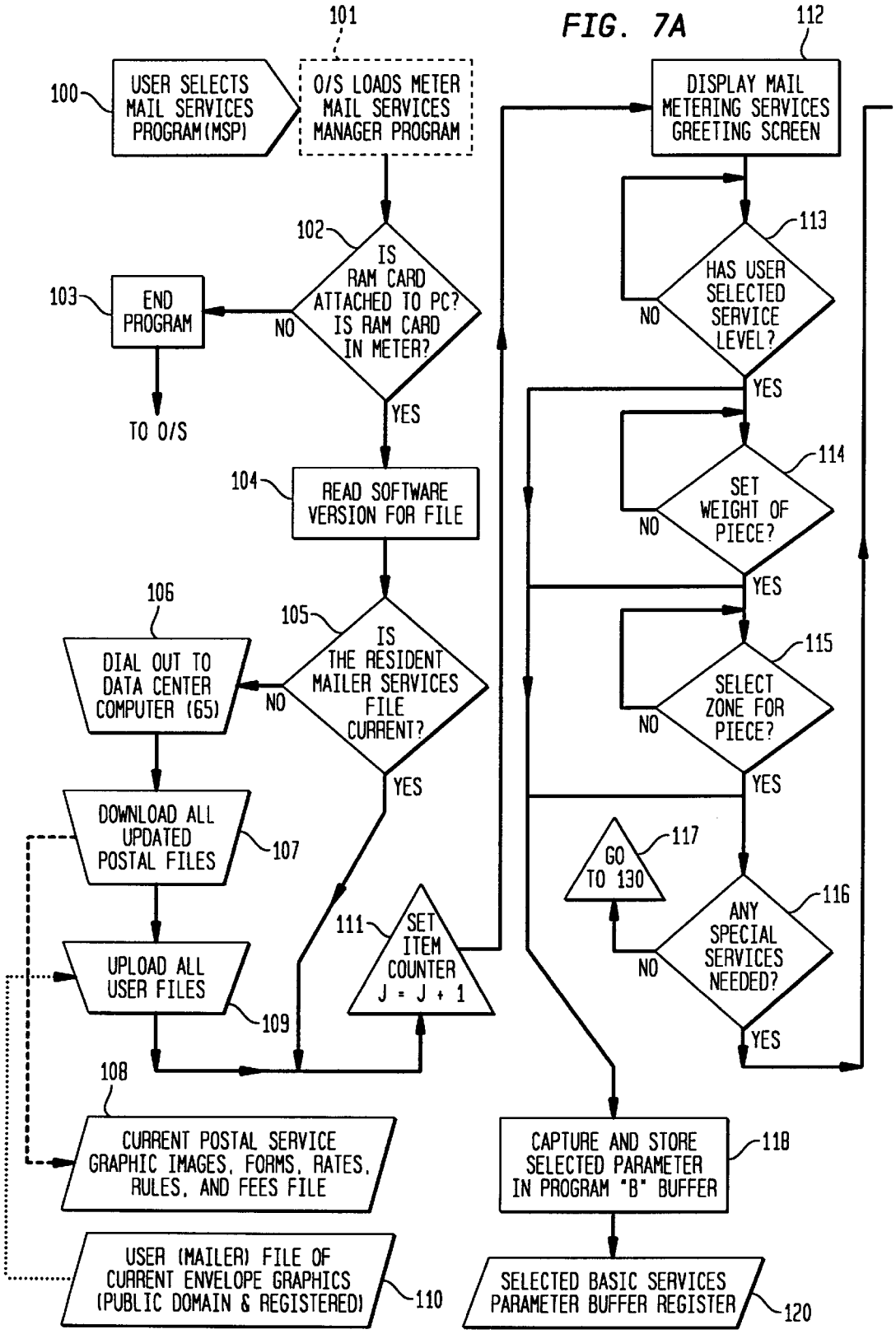
FIG. 7A
100
USER SELECTS MAIL SERVICES PROGRAM(MSP)
101
O/S LOADS METER MAIL SERVICES MANAGER PROGRAM
102
IS RAM CARD ATTACHED TO PC? IS RAM CARD IN METER?
NO
YES
103
END PROGRAM
TO O/S
104
READ SOFTWARE VERSION FOR FILE
105
IS THE RESIDENT MAILER SERVICES FILE CURRENT?
NO
YES
106
DIAL OUT TO DATA CENTER COMPUTER (65)
DOWNLOAD ALL UPDATED POSTAL FILES
107
UPLOAD ALL USER FILES
109
111
SET ITEM COUNTER J = J + 1
108
CURRENT POSTAL SERVICE GRAPHIC IMAGES, FORMS, RATES, RULES, AND FEES FILE
USER (MAILER) FILE OF CURRENT ENVELOPE GRAPHICS (PUBLIC DOMAIN & REGISTERED)
110
112
DISPLAY MAIL METERING SERVICES GREETING SCREEN
113
HAS USER SELECTED SERVICE LEVEL?
NO
YES
114
SET WEIGHT OF PIECE?
NO
YES
115
SELECT ZONE FOR PIECE?
NO
YES
116
ANY SPECIAL SERVICES NEEDED?
NO
YES
117
GO TO 130
118
CAPTURE AND STORE SELECTED PARAMETER IN PROGRAM "B" BUFFER
SELECTED BASIC SERVICES PARAMETER BUFFER REGISTER
120

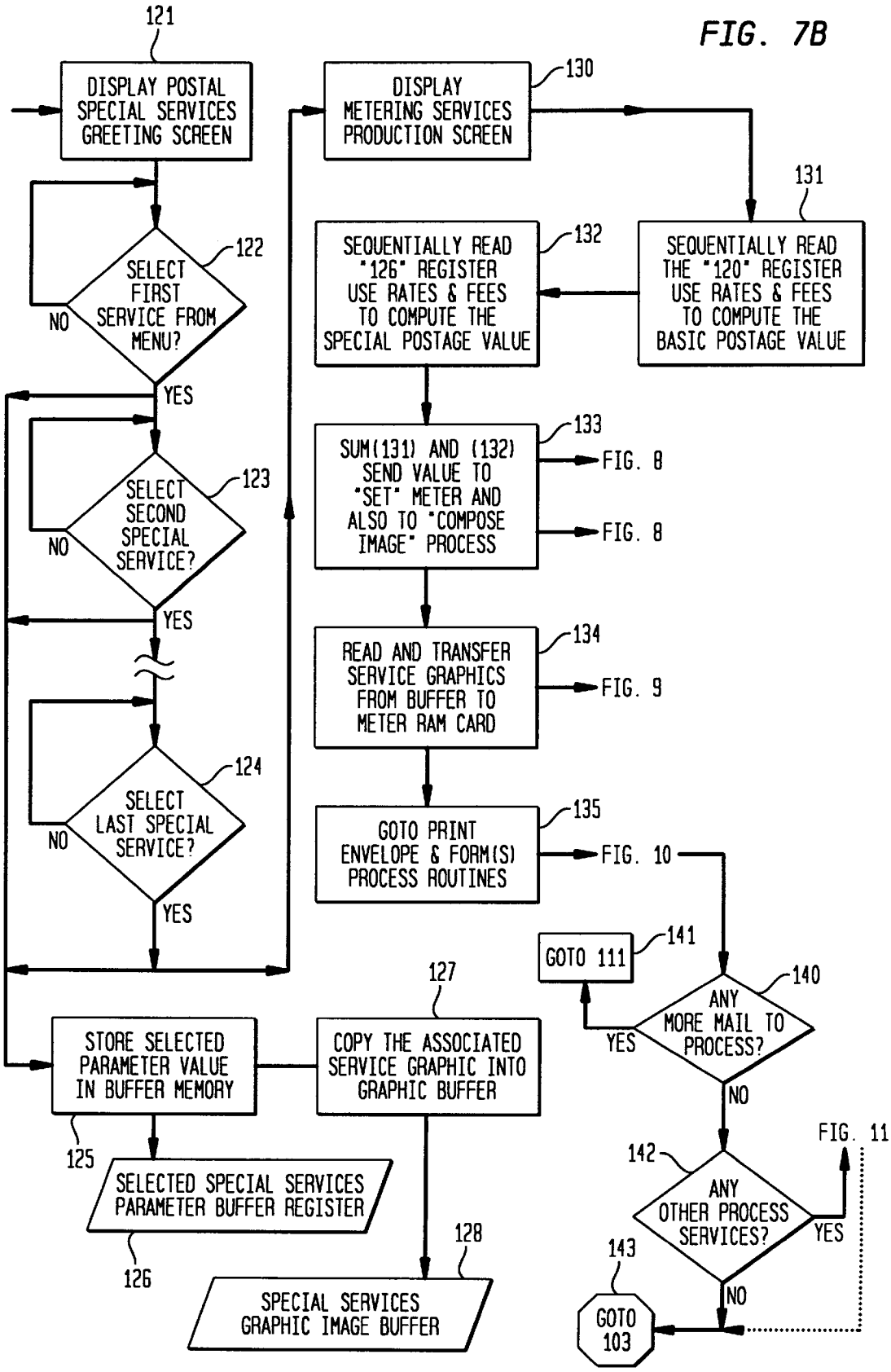
FIG. 7B
121
DISPLAY POSTAL SPECIAL SERVICES GREETING SCREEN
122
SELECT FIRST SERVICE FROM MENU?
NO
YES
123
SELECT SECOND SPECIAL SERVICE?
NO
YES
124
SELECT LAST SPECIAL SERVICE?
NO
YES
125
STORE SELECTED PARAMETER VALUE IN BUFFER MEMORY
126
SELECTED SPECIAL SERVICES PARAMETER BUFFER REGISTER
127
COPY THE ASSOCIATED SERVICE GRAPHIC INTO GRAPHIC BUFFER
128
SPECIAL SERVICES GRAPHIC IMAGE BUFFER
130
DISPLAY METERING SERVICES PRODUCTION SCREEN
131
SEQUENTIALLY READ THE "120" REGISTER USE RATES & FEES TO COMPUTE THE BASIC POSTAGE VALUE
132
SEQUENTIALLY READ "126" REGISTER USE RATES & FEES TO COMPUTE THE SPECIAL POSTAGE VALUE
133
SUM(131) AND (132) SEND VALUE TO "SET" METER AND ALSO TO "COMPOSE IMAGE" PROCESS
FIG. 8
FIG. 8
134
READ AND TRANSFER SERVICE GRAPHICS FROM BUFFER TO METER RAM CARD
FIG. 9
135
GOTO PRINT ENVELOPE & FORM(S) PROCESS ROUTINES
FIG. 10
140
ANY MORE MAIL TO PROCESS?
YES
NO
141
GOTO 111
142
ANY OTHER PROCESS SERVICES?
YES
NO
FIG. 11
143
GOTO 103

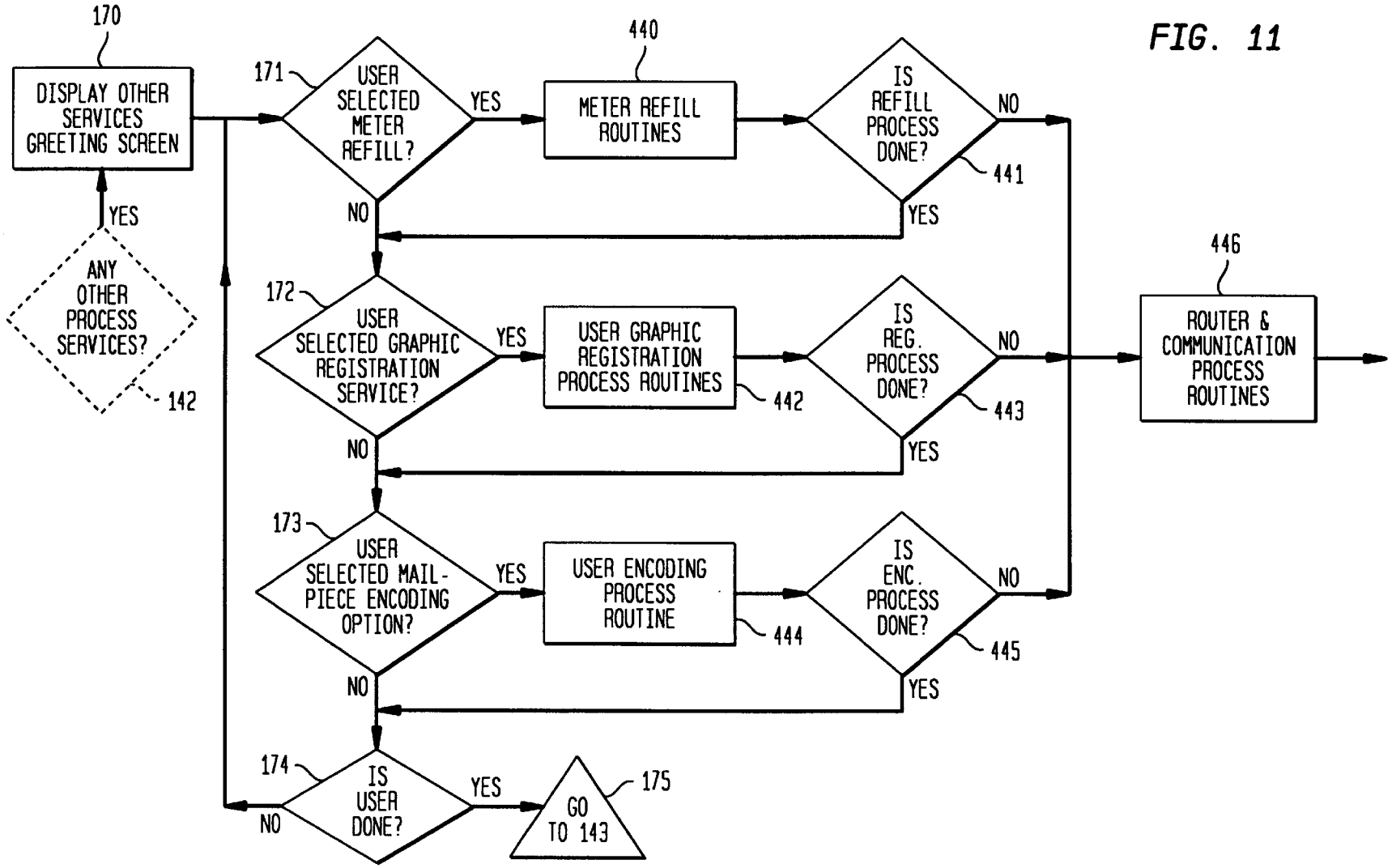
FIG. 11
DISPLAY OTHER SERVICES GREETING SCREEN
170
ANY OTHER PROCESS SERVICES?
142
YES
USER SELECTED METER REFILL?
171
YES
NO
METER REFILL ROUTINES
440
IS REFILL PROCESS DONE?
441
YES
NO
USER SELECTED GRAPHIC REGISTRATION SERVICE?
172
YES
NO
USER GRAPHIC REGISTRATION PROCESS ROUTINES
442
IS REG. PROCESS DONE?
443
YES
NO
USER SELECTED MAIL-PIECE ENCODING OPTION?
173
YES
NO
USER ENCODING PROCESS ROUTINE
444
IS ENC. PROCESS DONE?
445
YES
NO
IS USER DONE?
174
YES
NO
GO TO 143
175
ROUTER & COMMUNICATION PROCESS ROUTINES
446

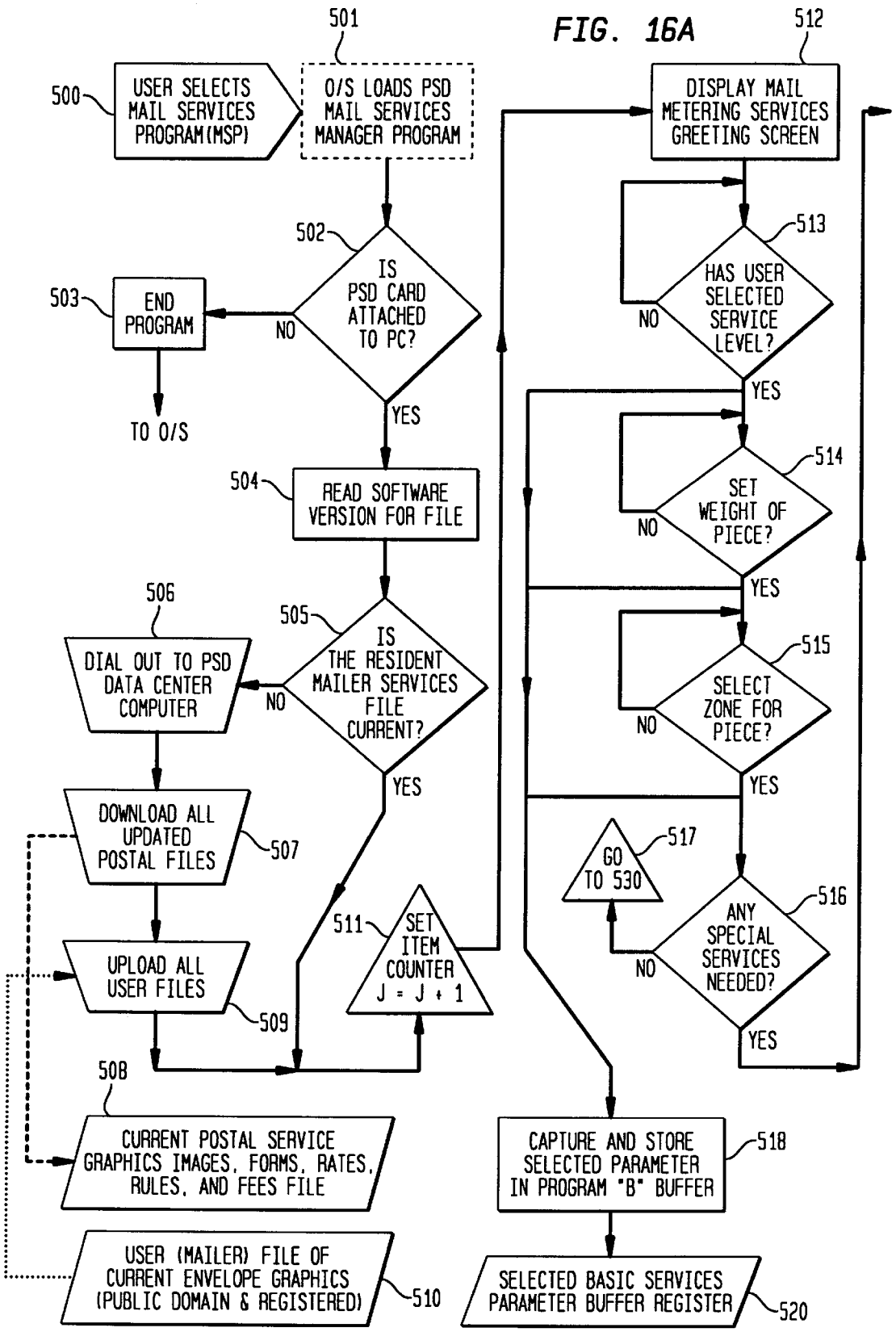
FIG. 16A
500
USER SELECTS MAIL SERVICES PROGRAM(MSP)
501
O/S LOADS PSD MAIL SERVICES MANAGER PROGRAM
502
IS PSD CARD ATTACHED TO PC?
NO
503
END PROGRAM
TO O/S
YES
504
READ SOFTWARE VERSION FOR FILE
505
IS THE RESIDENT MAILER SERVICES FILE CURRENT?
NO
506
DIAL OUT TO PSD DATA CENTER COMPUTER
YES
DOWNLOAD ALL UPDATED POSTAL FILES
507
UPLOAD ALL USER FILES
509
508
CURRENT POSTAL SERVICE GRAPHICS IMAGES, FORMS, RATES, RULES, AND FEES FILE
USER (MAILER) FILE OF CURRENT ENVELOPE GRAPHICS (PUBLIC DOMAIN & REGISTERED)
510
511
SET ITEM COUNTER J = J + 1
512
DISPLAY MAIL METERING SERVICES GREETING SCREEN
513
HAS USER SELECTED SERVICE LEVEL?
NO
YES
514
SET WEIGHT OF PIECE?
NO
YES
515
SELECT ZONE FOR PIECE?
NO
YES
516
ANY SPECIAL SERVICES NEEDED?
NO
YES
517
GO TO 530
518
CAPTURE AND STORE SELECTED PARAMETER IN PROGRAM "B" BUFFER
SELECTED BASIC SERVICES PARAMETER BUFFER REGISTER
520

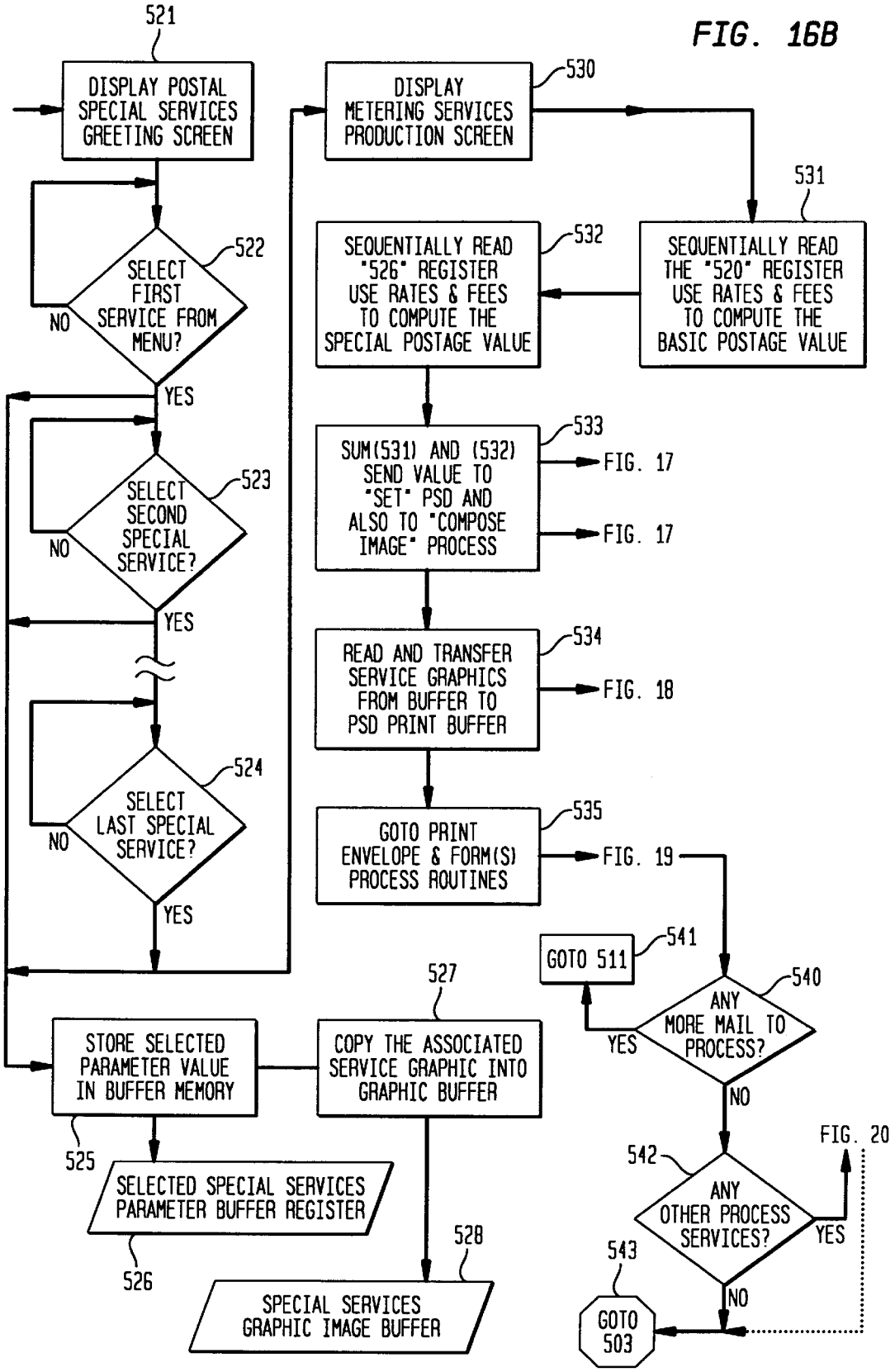
FIG. 16B
521
DISPLAY POSTAL SPECIAL SERVICES GREETING SCREEN
522
SELECT FIRST SERVICE FROM MENU?
NO
YES
523
SELECT SECOND SPECIAL SERVICE?
NO
YES
524
SELECT LAST SPECIAL SERVICE?
NO
YES
530
DISPLAY METERING SERVICES PRODUCTION SCREEN
531
SEQUENTIALLY READ THE "520" REGISTER USE RATES & FEES TO COMPUTE THE BASIC POSTAGE VALUE
532
SEQUENTIALLY READ "526" REGISTER USE RATES & FEES TO COMPUTE THE SPECIAL POSTAGE VALUE
533
SUM(531) AND (532) SEND VALUE TO "SET" PSD AND ALSO TO "COMPOSE IMAGE" PROCESS
FIG. 17
FIG. 17
534
READ AND TRANSFER SERVICE GRAPHICS FROM BUFFER TO PSD PRINT BUFFER
FIG. 18
535
GOTO PRINT ENVELOPE & FORM(S) PROCESS ROUTINES
FIG. 19
541
GOTO 511
540
ANY MORE MAIL TO PROCESS?
YES
NO
527
COPY THE ASSOCIATED SERVICE GRAPHIC INTO GRAPHIC BUFFER
STORE SELECTED PARAMETER VALUE IN BUFFER MEMORY
525
SELECTED SPECIAL SERVICES PARAMETER BUFFER REGISTER
526
528
SPECIAL SERVICES GRAPHIC IMAGE BUFFER
542
ANY OTHER PROCESS SERVICES?
YES
NO
FIG. 20
543
GOTO 503

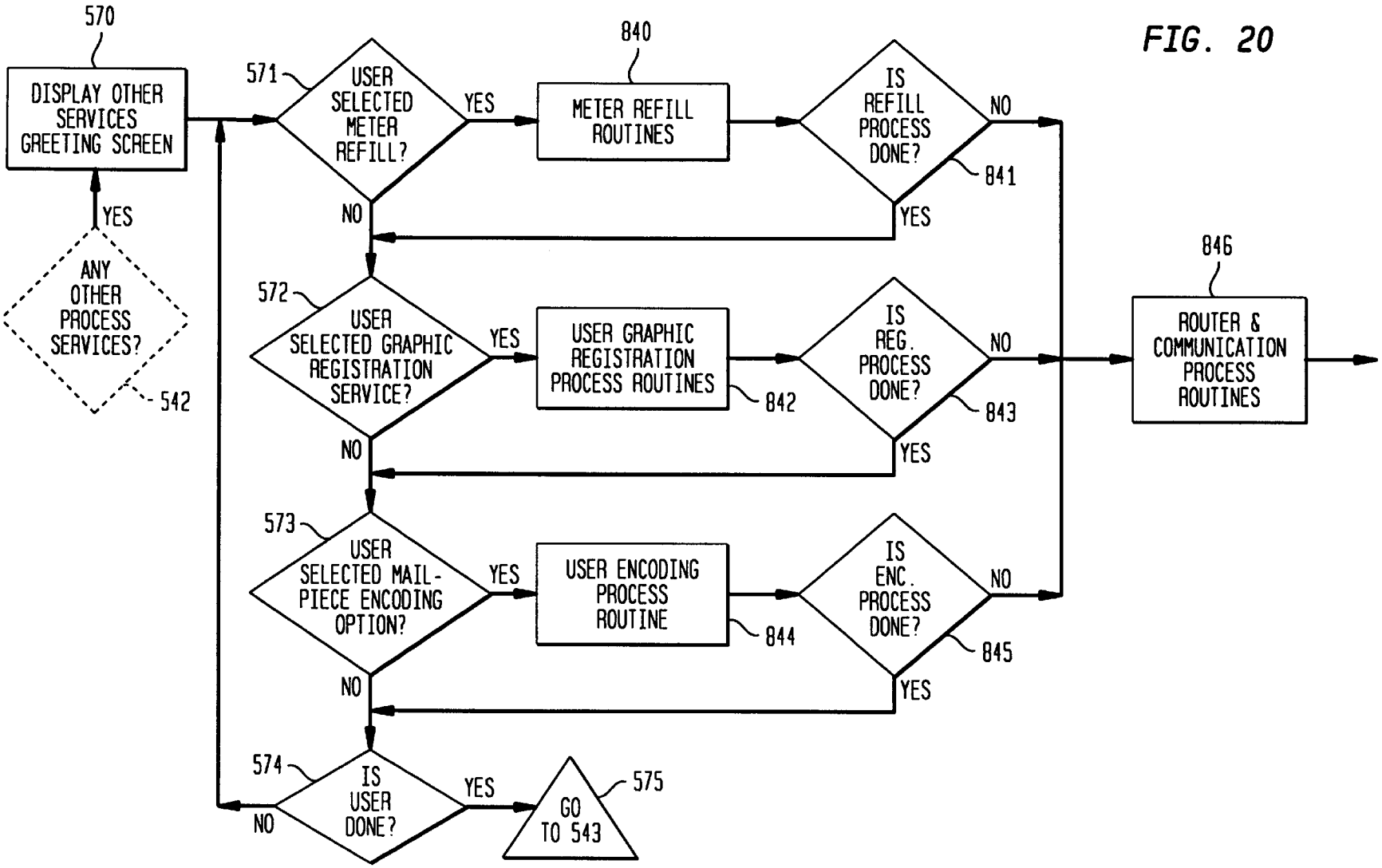
FIG. 20
570
DISPLAY OTHER SERVICES GREETING SCREEN
YES
ANY OTHER PROCESS SERVICES?
542
571
USER SELECTED METER REFILL?
YES
NO
840
METER REFILL ROUTINES
841
IS REFILL PROCESS DONE?
YES
NO
572
USER SELECTED GRAPHIC REGISTRATION SERVICE?
YES
NO
842
USER GRAPHIC REGISTRATION PROCESS ROUTINES
843
IS REG. PROCESS DONE?
YES
NO
573
USER SELECTED MAIL-PIECE ENCODING OPTION?
YES
NO
844
USER ENCODING PROCESS ROUTINE
845
IS ENC. PROCESS DONE?
YES
NO
574
IS USER DONE?
YES
NO
575
GO TO 543
846
ROUTER & COMMUNICATION PROCESS ROUTINES

DIGITAL PRINTING, METERING, AND RECORDING OF OTHER POST SERVICES ON THE FACE OF A MAIL PIECE

FIELD OF THE INVENTION

The invention relates generally to the field of postage meters and more particularly to the digital printing of postage indicia and the recording of other post services on the face of a mail piece.

BACKGROUND OF THE INVENTION

Historically postage meters have been mechanical and electromechanical devices that: maintain through mechanical or "electronic registers" (postal security devices) an account of all postage printed and the remaining balance of prepaid postage; and print postage postmarks (indicia) that are accepted by the postal service as evidence of the prepayment of postage. With the introduction of postage meters that print a postal indicia by means of digital printing it became possible to print slogans and advertising material in the vicinity of the postal indicia.

The United States Postal Service currently handles large volumes of normal mail, i.e., first class mail, second class mail and third class mail. However when it comes to specialty mail, i.e., priority mail, certified mail and registered mail, the United States Postal Service uses gummed service stickers, and forms to indicate and process the specialty mail. The unnecessary use of gummed service stickers and completion of forms by hand is time consuming, error prone and hence raises the expense for receiving these services. Furthermore, the use of some services, i.e., certified mail requires the mailer to physically deliver the mail piece to the post.

SUMMARY OF THE INVENTION

The present invention overcomes the disadvantages of the prior art by providing a inexpensive and time saving method and system for reducing the use of gummed service stickers and the completion by hand of special forms and cards for specialty mail. This invention also reduces the amount of trips that have to be made to the post. The foregoing may be accomplished by replacing the standard (fixed) graphic cartridge that is normally supplied with a standard digital postage meter with an addressable "ram" image card. The addressable ram image card can also be linked to a personal computer, where a program would allow the user to request specialty mail services. Alternatively, a personal computer that is not coupled to a standard digital postage meter may be used if it is connected to a postal security device. Once the desired service (services) are selected, the required postal graphic images are downloaded into the ram card. Next, postal payment is calculated and the additional postal value is totaled and passed to the postal meter vault for processing and then printing in an accountable way. Finally, the personal computer meter or postage meter, cycles, normally first printing the indicia and then the graphics and bar codes as specified by each postal service that was selected by the user.

The program contained in the personal computer would collect and store all necessary data for the postal services selected, such as trace and track (TT) number, destination, fund amounts, fees etc. The above information may be in the form of a manifest, or other form. In any event the above information could be transmitted to the post via modem or during a meter refill, etc.

BRIEF DESCRIPTION OF THE DRAWING

FIG. 7 is a flow chart of the mail services program contained within computer 50 of FIG. 5;

FIG. 11 is a block diagram showing how other mail related services are processed;

FIG. 16 is a flow chart of the mail services program contained within computer 71 of FIG. 6;

FIG. 20 is a block diagram showing how other mail related services are processed.

DETAILED DESCRIPTION OF THE PREFERRED EMBODIMENT

Figure 1:
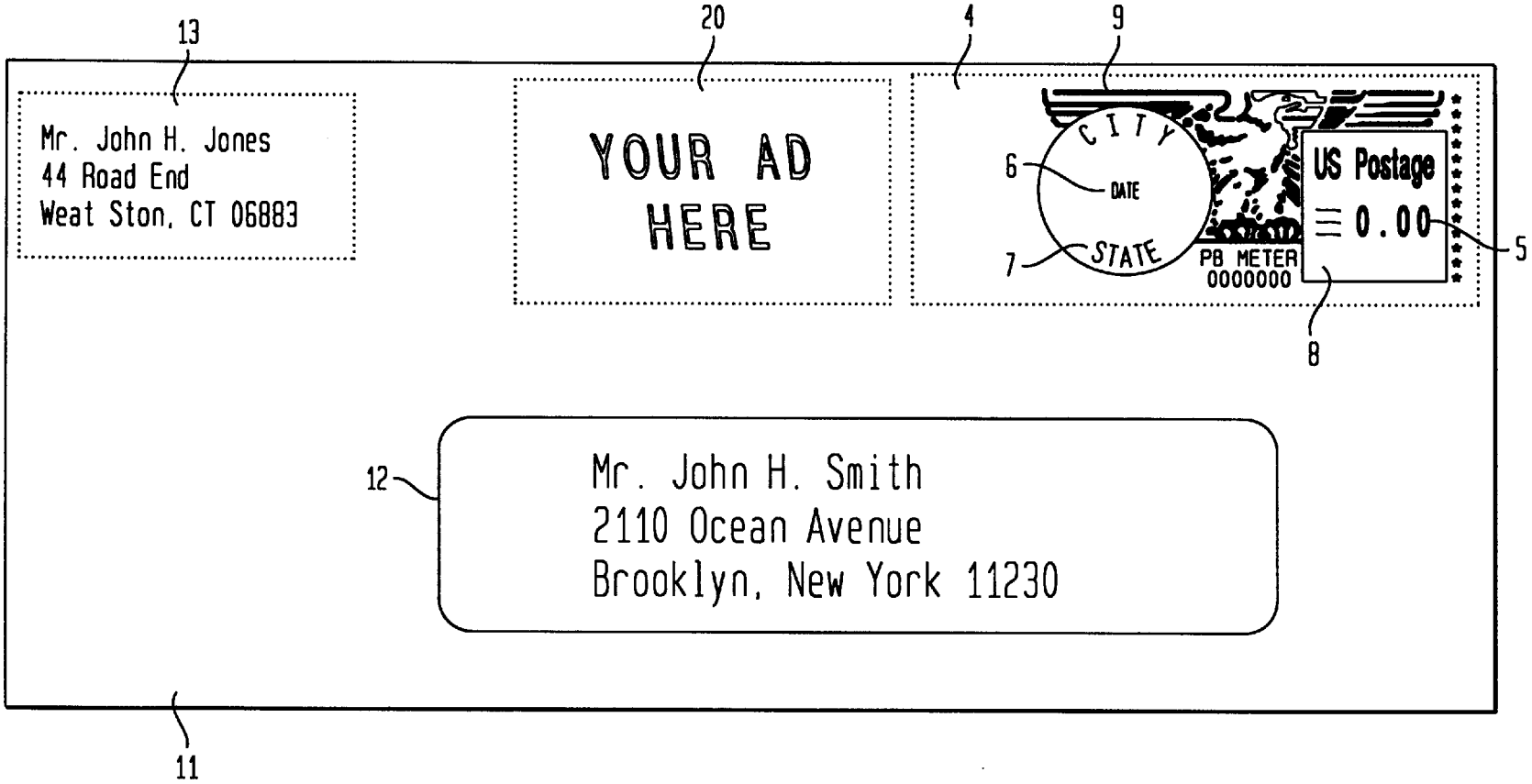
FIG. 1 is a drawing of a prior art mail piece containing a postal indicia and a advertising slogan that was affixed by a mechanical meter.

Referring now to the drawings in detail, and more particularly to FIG. 1, the reference character 11 represents a prior art mail piece that has a recipient address field 12 and a sender address field 13. A postal indicia 4 that was made by a mechanical postage meter is affixed to mail piece 11. Indicia 4 contains a dollar amount 5, the date 6, that postal indicia 4 was affixed to mail piece 11, the place the mail piece was mailed from 7, the postal meter serial number 8 and an eagle 9. An advertising slogan 20 is also affixed to mail piece 11.

Figure 2:
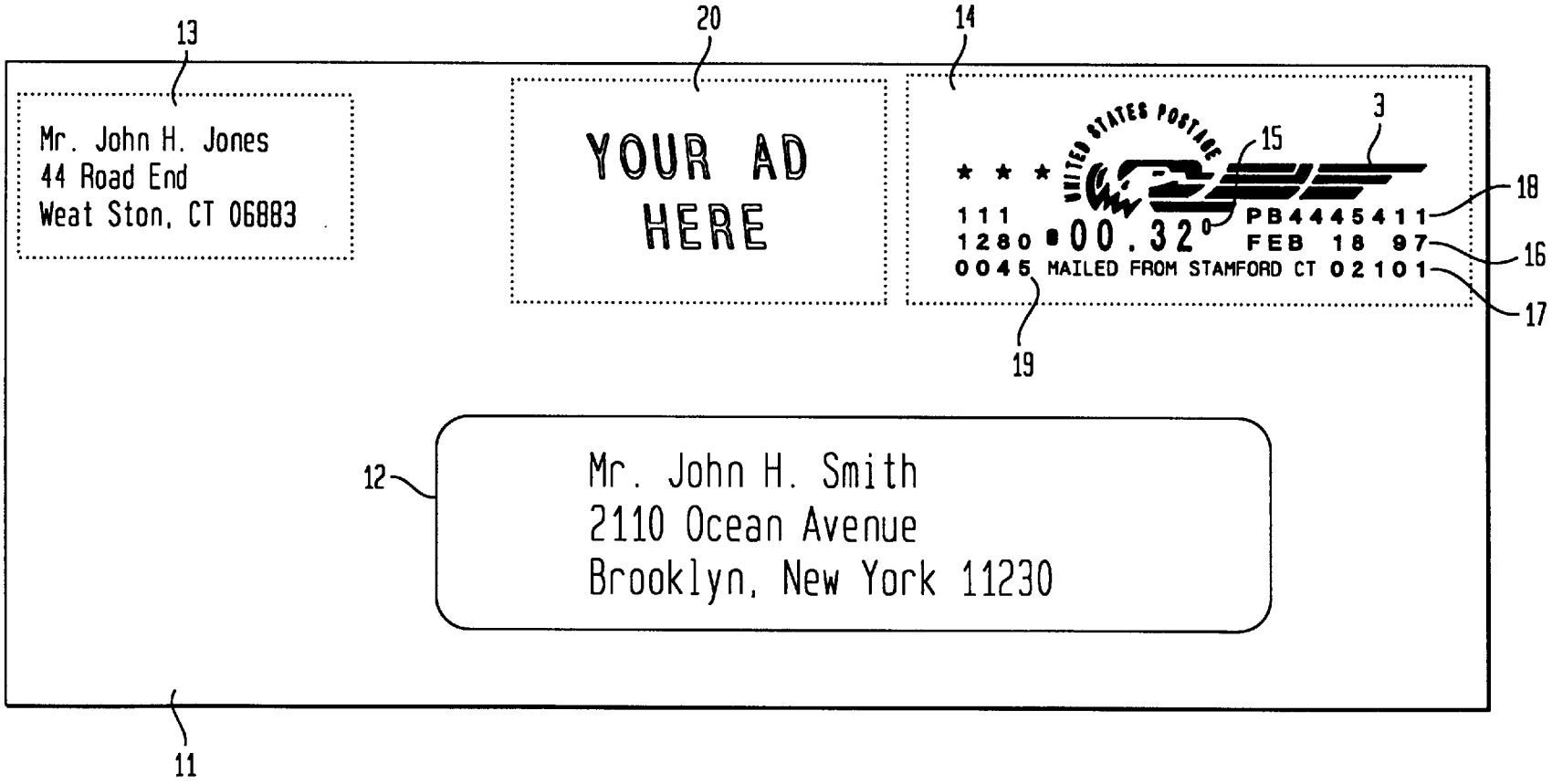
FIG. 2 is a drawing of a prior art mail piece containing a postal indicia and a advertising slogan that was affixed by a electronic meter.

FIG. 2 is a drawing of a prior art mail piece containing a postal indicia 14, and an advertising slogan 20 that was affixed by a electronic meter. Mail piece 11 has a recipient address field 12 and a sender address field 13. A postal indicia 14 is affixed to mail piece 11. Indicia 14 contains a dollar amount 15, the date 16, that postal indicia 11 was affixed to mail piece 11, the place 17 that mail piece 11 was mailed, the postal meter serial number 18, an eagle 3 and a security code 19. An advertising slogan 20 is also affixed to mail piece 11.

Figure 3:
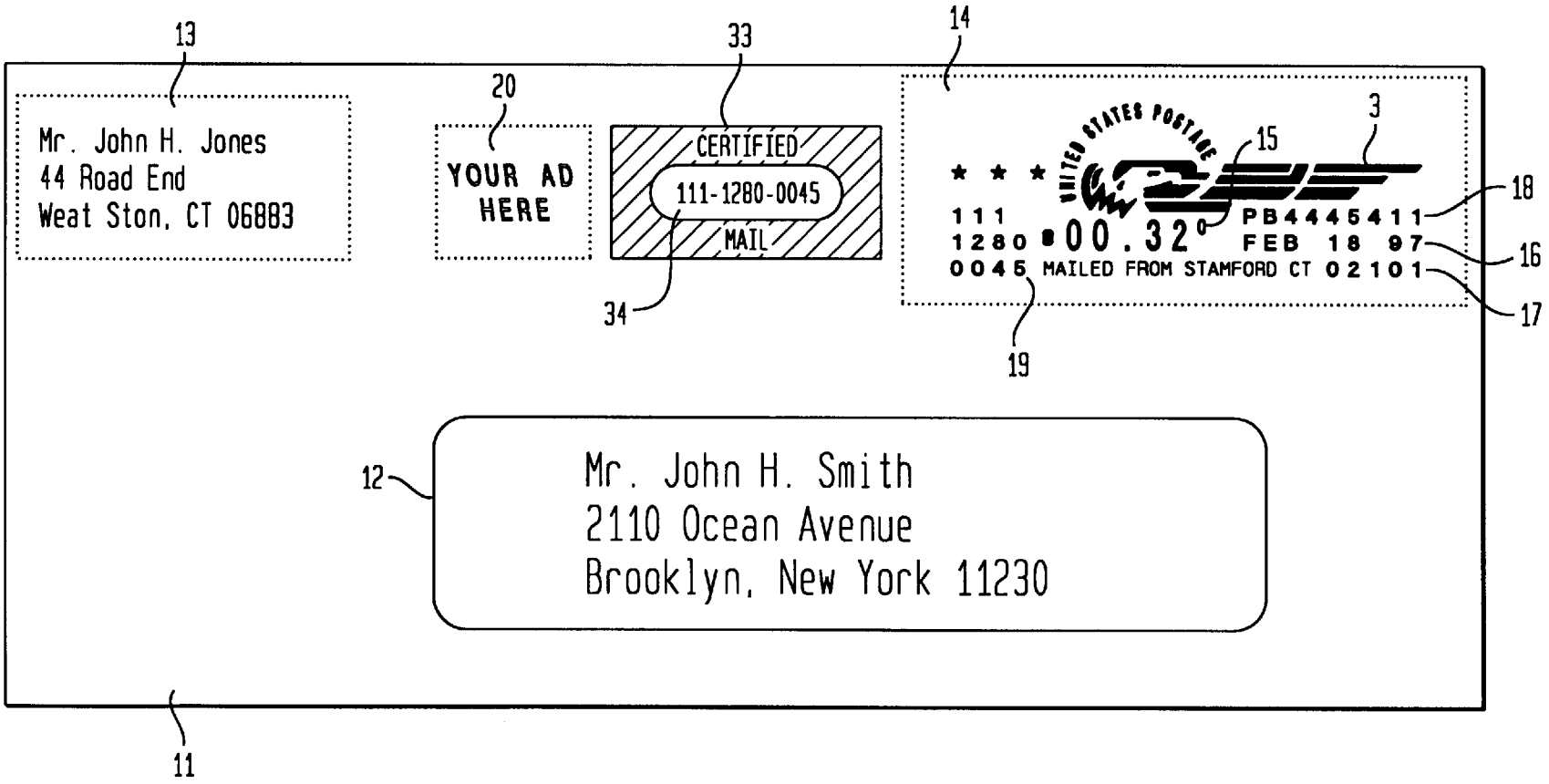
FIG. 3 is a drawing of a mail piece containing a postal indicia and other mail services that have been requested by the mailer.

FIG. 3 is a drawing of a mail piece 11 containing a postal indicia 14 and other mail services that have been requested by the mailer. Mail piece 11 has a recipient address field 12 and a sender address field 13. A postal indicia 14 is affixed to mail piece 11. Indicia 14 contains a dollar amount 15, the date 16, that postal indicia 11 was affixed to mail piece 11, the place 17 that mail piece 11 was mailed, the postal meter serial number 18, an eagle 3 and a security code 19. Security code 19 is a unique number that is derived from address field 12 and information contained in the postage meter that affixed indicia 14. The manner in which security code 19 is obtained is disclosed in the Sansone et al U.S. Pat. No. 4,831,555 entitled "Unsecured Postage Applying System" herein incorporated by reference. A certified mail graphic 33 is affixed to mail piece 11. Graphic 33 contains a serial number 34. Serial number 34 may be derived from security code 19 or may be security code 19. The manner in which serial number 34 is affixed to mail piece 11, will be more fully described in the description of FIG. 10. An advertising slogan 20 is also affixed to mail piece 11.

Currently in Ireland an expedited courier services is being offered by the post using prepaid stickers that are affixed to the mail piece. It would be obvious to one skilled in the art that this invention eliminates the need for a prepaid sticker in the above application. A graphic representation could be printed instead of graphic 33 and the Ireland postal indicia printed instead of postal indicia 14.

Figure 4:
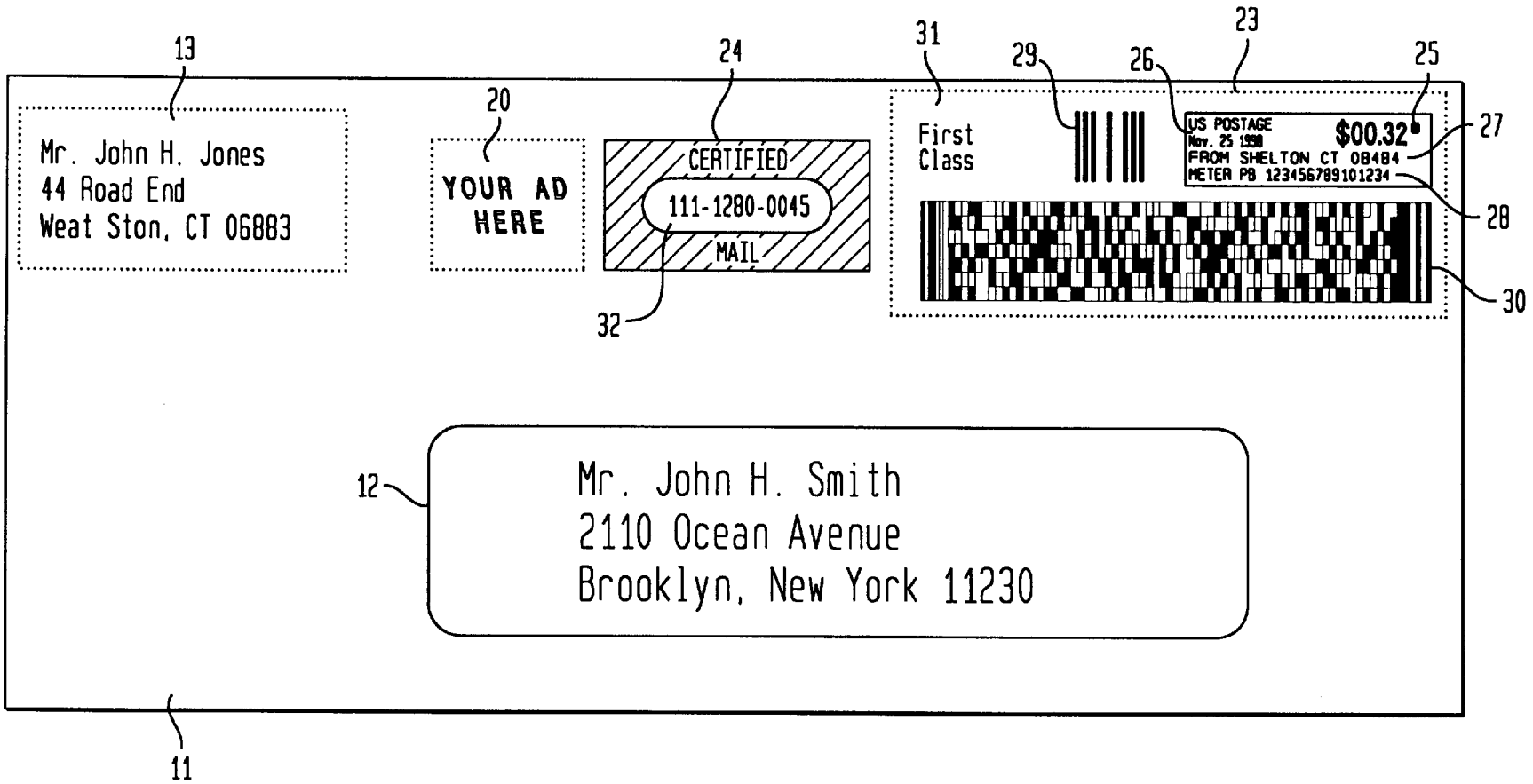
FIG. 4 is a drawing of a mail piece containing a Information—Based Indicia and other mail service graphics that have been requested by the mailer.

FIG. 4 is a drawing of a mail piece 11 containing a Information—Based Indicia and other mail service graphics that have been requested by the mailer. Mail piece 11 has a recipient address field 12 and a sender address field 13. Mail piece 11 also contains a USPS Information—Based Indicia (IBI) 23 and a certified mail symbol 24. Certified mail symbol 24 includes a serial number 32. The United States Postal Service Engineering Center recently published a notice of proposed specification that describes a Information Based Indicia. The title of the specification is Information Based Indicia Program Postal Security Device Specification, dated Jun. 13, 1996, herein incorporated by reference. The Information Based Indicia Program specification includes both proposed specifications for the new indicium and proposed specifications for a postal security device (PSD). The postal indicia 23 contains a dollar amount 25, the date 26, that the postal indicia was affixed to mail piece 11, the place 27 that mail piece 11 was mailed, the postal security device serial number 28, a FIM code 29 and a 2D encrypted bar code 30. Serial number 32 may be derived from bar code 30 or be equal to bar code 30. Bar code 30 is a unique number that is derived from address field 12 and information contained in the postal security device that affixed IBI 23. The manner in which bar code 30 is obtained is disclosed in the Sansone, et al. U.S. Pat. No. 4,831,555 entitled "UNSECURED POSTAGE APPLYING SYSTEM," herein incorporated by reference. Mail piece 11 also contains an indication 31 of the class of mail piece 11. Certified mail symbol 24 includes a serial number 32. The manner in which symbol 24 is affixed to mail piece 11 will be more fully described in the description of FIG. 10. An advertising slogan 20 is also affixed to mail piece 11.

Figure 5:
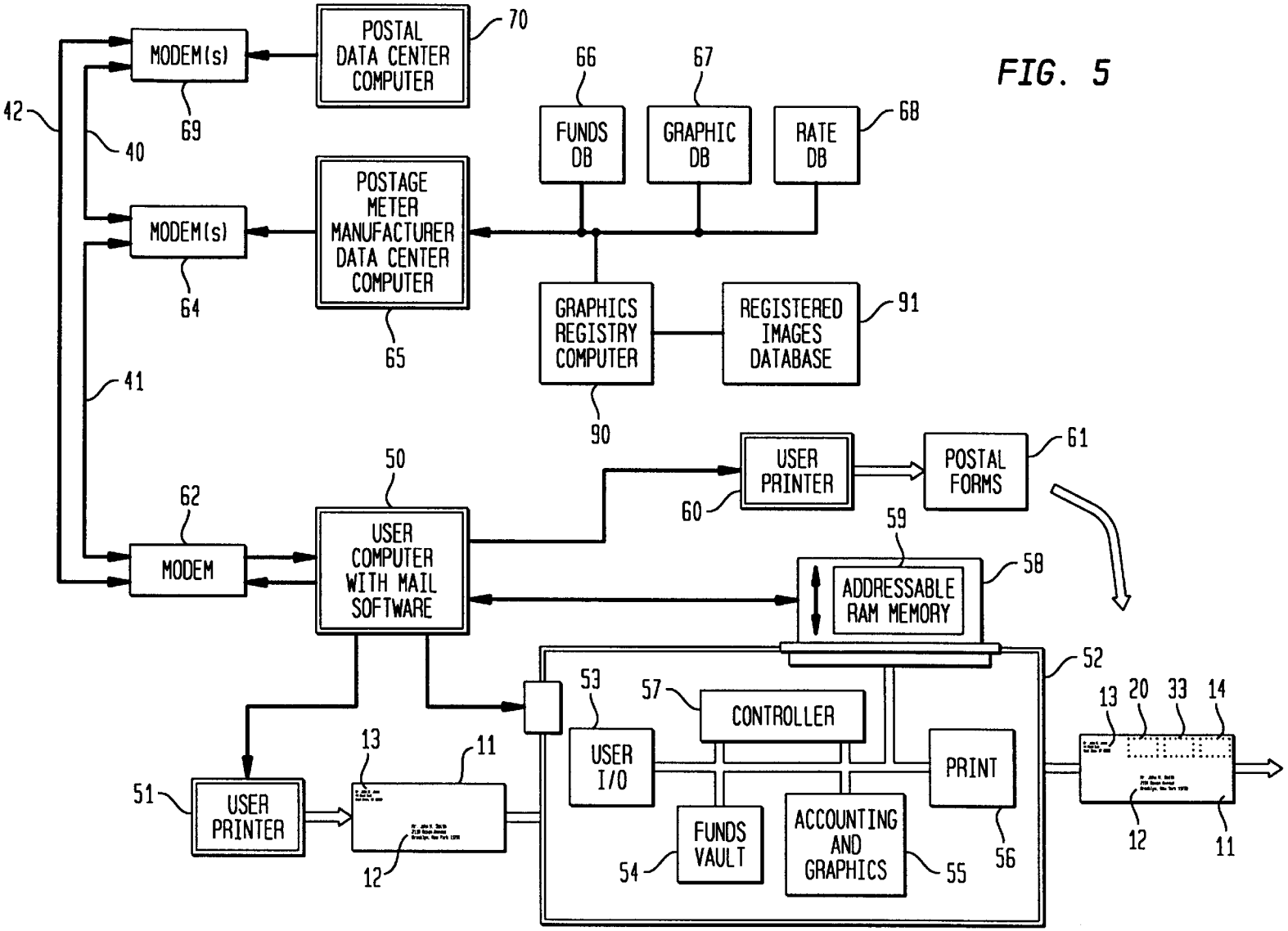
FIG. 5 is a block diagram of a personal computer, a digital postage meter and data centers.

FIG. 5 is a block diagram of a mailers personal computer 50 and a postage meter 52. A mailers personal computer 50 is connected to printer 51. Printer 51 is controlled by a mail program which is contained in computer 50 and is more fully described in the description of FIG. 10. Printer 51 prints the contents of mail piece 11, recipient address field 12 and a sender address field 13.

Computer 50 is connected to digital postage meter 52. Postage meter 52 comprises: a user input/output device 53 that receives mail piece 11; a funds vault 54 that represents the value of the postage that may be used by meter 52, vault 54 that is coupled to device 53; an accounting and graphics module 55 that contains information used to print indicia 14 and graphic 33 and ad slogan 20, module 55 is coupled to device 53; a printer 56 that is coupled to device 53; a removable random access memory card 58, card 58 is coupled to device 53; a controller 57 that is coupled to device 53, funds vault 54, accounting and graphics module 55, printer 56, removable random access memory 59 image card 58, and an addressable ram memory contained within card 58. It would be obvious to one skilled in the art that random access memory card 58 may be attached to computer 50 and to controller 57. Printer 56 prints indicia 14, certified mail graphic 33 and advertising slogan 20 on mail piece 11.

Computer 50 is coupled to removable random access memory card 58. Computer 50 is also coupled to user printer 60. Printer 60 is used to print and complete postal forms 61 that are attached to mail piece 11, i.e., the receipt for certified mail and the receipt for insured mail, etc.

Computer 50 is coupled to postage meter manufacturer data center 65 via modem 62, communications path 41 and modem 64. Postage meter manufacturer data center computer 65 is coupled to: modem 62; a funds data base 66; a graphics data base 67; wherein data base 67 contains public interest statements, and advertising slogans that may be placed on mail piece 11 in the space reserved for advertising slogans 20 and postal graphics that are used to produce indicia 14 and graphic 33; and a service rate data base 68. Computer 65 is also coupled to graphic registry computer 90. Computer 90 is coupled to registered image data base 91. graphic images. Computer 65 is used to control data flow between computer 50 and computer 90.

Modem 69 is coupled to modem 64 via communications path 40 and modem 69 is coupled to modem 62 via communications path 42. Modem 69 is also coupled to postal data center computer 70. Data center computer 70 is used to send and receive postal data as well as mail piece specific data.

Figure 6:
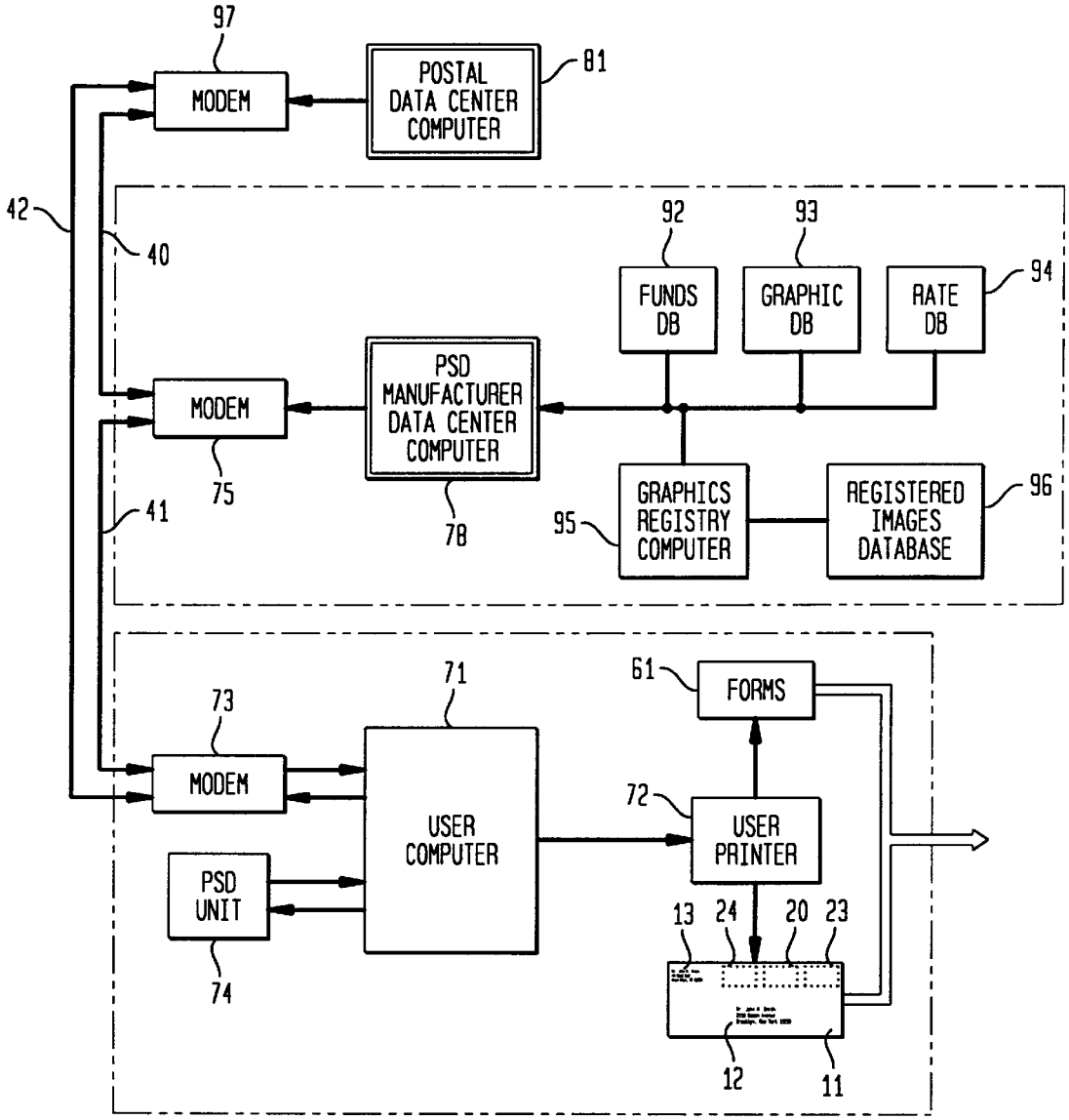
FIG. 6 is a block diagram of a personal computer and a postal security device.

FIG. 6 is a block diagram of a personal computer 71 and a postal security device 74. Computer 71 is coupled to printer 72, modem 73 and postal security device 74. Postal security device (PSD) 74 is specified in the Information Based Indicia Program Postal Security Device Specification, dated Jun. 13, 1996. PSD 74 is expected to be a hardware component for use with a computer based mail metering system. PSD 74 will be a unique security device. The core security functions of PSD 74 are cryptographic digital signature generation and verification and secure management of the registers that track the remaining amount of money available for indicia creation i.e., descending register and the total postage value used by PSD 74 i.e., ascending register. PSD 74 will be a tamper—resistant device that may contain an internal random number generator, various storage registers, a date/time clock and other circuits necessary to perform the foregoing functions. PSD 74 will comply with Federal Information Processing Standard (FIPS) 140-1 published by the United States Department Of Commerce, National Bureau of Standards, and will be validated through the National Institute of Standards (NIST) Computer Systems Laboratory's Cryptographic Module Validation Program.

Computer 71 tells printer 72 when and how to print: address field 12, return address field 13, IBI indicia 23, certified mail symbol 24 and ad slogan 20 on mail piece 11. Printer 72 is used to print and complete the postal forms 61 (FIGS. 12 and 13) and the return receipt cards (shown in FIGS. 14 and 15) that are attached to mail piece 11, etc. It would be obvious to one skilled in the art that different specialty mail services or other services may be placed in the area taken by graphic 33.

Modem 73 is coupled to PSD manufacture modem 75 via communications path 41 and modem 73 is coupled to postal user modem 97 via communications path 40. Modem 73 is coupled to modem 97 via communications path 42. Modem 75 is coupled to PSD manufacturer's computer 78. Postage meter manufacturer data center computer 78 is coupled to: a funds data base 92; a graphics data base 93; wherein data base 93 contains public interest statements, and advertising slogans that may be placed on mail piece 11 in the space reserved for advertising slogans 20 and postal graphics that are used to produce indicia 14 and symbol 24; and a service rate data base 94. Computer 78 is also coupled to graphic registry computer 95. Computer 95 is coupled to registered image data base 96. Computer 78 is used to control data flow between computer 95 and computer 71.

Modem 97 is coupled to postal data computer 81. Modem 97 is coupled to modems 73 and 75.

FIG. 7 is a flow chart of the Mail Services program contained within computer 50 of FIG. 5. The program begins in block 100 where the user selects the mail services program. Then the operating system of computer 50 loads the meter mail services manager program in block 101. At this point the program proceeds to decision block 102 to determine whether or not ram card 58 (FIG. 5) is attached to meter 52 or whether or not ram card 58 is attached to computer 50. If, ram card 58 is not attached to personal computer, 50 or meter 52, then the program goes to block 103 and ends the program. This information is sent back to the operating system of computer 50. If, the answer to the above question was yes, then the program proceeds to block 104 to read the software version for file. At this point the program goes to decision block 105 to determine whether or not the resident mailer service file is current. If block 105 determines that the resident mailer service file is not current, then the program goes to block 106 to dial out to data center computer 65 (FIG. 5). Now the program goes to block 107 to download all the updated postal files. This is accomplished by obtaining from block 108 the current postal service graphic images, forms, rates, rules and fee files. Now, the program goes to block 109 to upload all user files. The user files are obtained from block 110, the files are the user mailer file of current mail piece graphics (public domain and registered). If, decision block 105 determines that the resident mailer service file is current, then the program proceeds to block 111 to set item counter J=1. The program will also proceed to block 111 after uploading all the user files from block 109.

At this point the program proceeds to block 112 to display the mail metering services greetings on the display of computer 50. Then the program proceeds to decision block 113 to determine whether or not the user has selected one of the offered services, i.e., first class mail, second class mail, third class mail, etc. If, the user has not selected a service level then the program goes back to the input of block 113. If, the user has selected a service level then the program proceeds to block 118 to capture and store the selected parameter in program "B buffer". The program will also go to decision block 114 to determine whether or not the weight of the mail piece was set. If, the weight of the mail piece was not set then the program proceeds back to the input of block 114. If block 114 determines that the weight of the mail piece was set, then the program goes to block 118 to capture and store the selected weight in program "B buffer" the program also goes to decision block 115. Decision block 115 determines whether or not a postal zone for the mail piece has been selected. If, the zone has not been selected then the program goes back to the input of block 115. If, the zone has been selected then the program goes to block 118 to capture and store the selected zone parameter in program "B buffer" and to the input of decision block 116. Decision block 116 determines whether or not any special mail services are needed. If, no special services are needed then the program goes to block 117 and then to block 130 to display the metering services production screen on the display of computer 50. If, block 116 determines that special services are needed then the program goes to block 121 to display the postal special services on the greeting screen of the display of computer 50. The stored parameters in block 118 are transmitted to block 120 to select the basic services parameter buffer register.

At this point the program proceeds to decision block 122 to determine whether or not the first service has been selected from the menu on the screen of computer 50. The following are some of the services that may be selected: FIM; expedited delivery; trace and track; return receipt requested; insurance; international mail; expedited international; certified mail; registered mail, etc. If, decision block 122 determines that the first service listed in the menu was not selected then the program goes back to the input of decision block 122. If, decision block 122 determines that the first service on the menu was selected then the program proceeds to block 125 to store the selected parameter value in buffer memory. Then the program goes to block 126 to select the special services parameter buffer register. The program will also proceed to the input of decision block 123. Block 123 determines whether or not the second selected special service was selected. If, the second service was not selected then the program proceeds back to the input of block 123. If, the second service special service was selected then the program goes to block 125 to store the selected parameter value in the buffer memory and to block 126 to select the special services parameter buffer register. The program will proceed through a decision block for all of the services that were offered (not shown). At this point the program will proceed to decision block 124. Block 124 determines whether or not the last special service listed in the menu has been selected. If, block 124 determines that the last service on the list has not been selected then the program goes back to the input of block 124. If, block 124 determines that the last special service has been selected then the program goes to block 125. When the program finishes block 125 it goes to block 127 to copy the associated service graphics into the graphics buffer. Then the program goes to block 128 to special services graphic image buffer. These function will be at the outputs of blocks 122,123, and 124. If, the output to block 124 is yes then the program goes to store the selected parameter value in buffer memory in block 125 to copy the associated service graphics into graphic buffer in block 127 and to the special services graphic image buffer in block 128. The program will then go to block 126 to select the special services parameter buffer register. The program will then go to block 130 to display metering services on the production screen of computer 50. Then the program proceeds to block 131 to sequentially read the information contained in block 120, namely the selected basic services parameter buffer register, use rates and fees to compose the basic postage value. Now, the program goes to block 132 to sequentially read from block 126 the selected special services parameter buffer register use rates and fees to compute the special postage value. Then, the program goes to block 133 to sum block 131 and block 132. The sum of block 131 and 132 will be sent by block 133 to block 200 (FIG. 8) to obtain the meter postal value setting, i.e., to determine how much postage should be placed on the mail piece. Block 133 will also compose the image process and transfer this to decision block 205 (FIG. 8).

Figure 9:
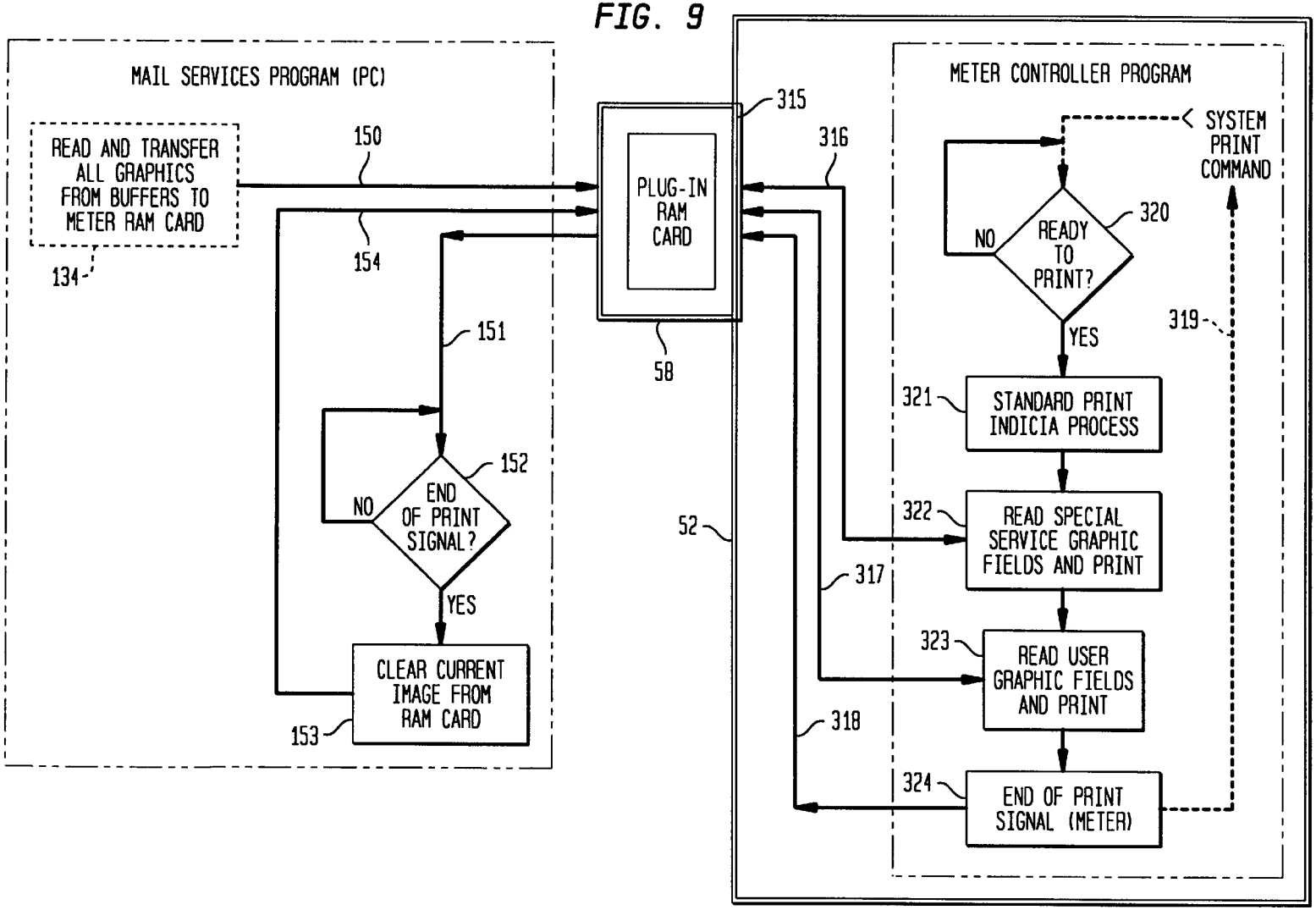
FIG. 9 is a flow chart showing how information is being transmitted to and from ram card 58 to produce graphics.

Then the program goes to block 134 to read and transfer service graphics from the buffer to meter ram card 58 (FIG. 9). The above information is sent to ram card 58 that is plugged into meter 52, i.e., it transfers the meter card routine. The program also goes to block 135 (FIG. 10) to print the mail piece and required forms and process routines. Upon completion of the subroutine in FIG. 10 the program goes to decision block 140. Decision block 140 determines whether or not any additional mail is to be processed. If additional mail is to be processed then the program goes to block 141 and then the program goes to block 111 to set the item counter J=1. If, decision block 140 determines that there are no more mail pieces to process then the program goes to decision block 142. Decision block 142 determines whether or not any other process services are requested. If, block 142 determines that no other process services are requested, then the program goes to block 143. Then the program proceeds to block 103 to end the program. If, block 142 determines that there are other process services that were requested then the program proceeds to FIG. 11 to determine if there are other process services that the user wants to affix, i.e., do you want to refill your meter, do you have any graphics to register with computers 65 and 90 and do you want to select mail piece encoding. After completing the subroutine shown in FIG. 11, the program goes to block 103 (FIG. 7).

Figure 8:
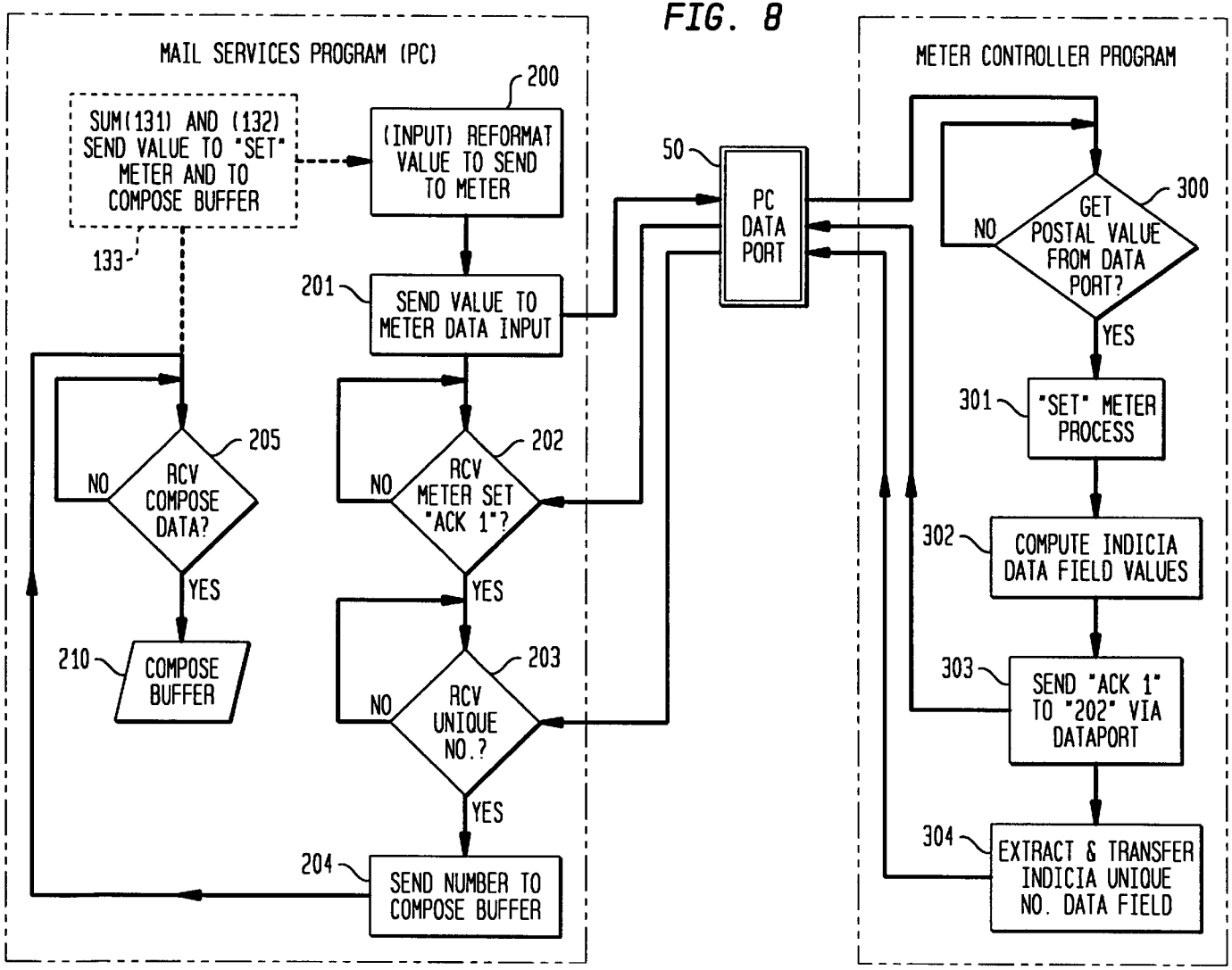
FIG. 8 is a flow chart of a program showing the interaction of the Mail Services Program with the Meter Controller Program to produce the indicia unique number, i.e. security code 19.

FIG. 8 is a flow chart of a program showing the interaction of the Mail Services Program with the Meter Controller Program to produce the indicia unique number, i.e security code 19. After completing the function described in block 133 (FIG. 7) the program goes to block 200 to reformat the value that is going to be sent to meter 52 (FIG. 5). Then, the program goes to block 201 to send the above value to the data port of computer 50 (FIG. 5) and then the program precedes to decision block 202. Decision block 202 determines whether or not meter 52 has returned an acknowledgment from computer 50. If, block 202 determines that no "acknowledgment 1" was received, then the program goes back to the input of block 202. If, block 202 determines that meter 52 received an "acknowledgment 1" from computer 50, then the program proceeds to decision block 203. Decision block 203 determines whether or not meter 52 received a unique number (security code 19) from computer 50. If, block 203 determines that security code 19 was not received, then the program goes back to the input of block 203. If, block 203 determines that security code 19 was received, then the program goes to block 204. Block 204 sends security code 19 to decision block 205.

Decision block 205 receives the security code 19 from composed buffer block 204 and the sum 131 and 132 from block 133. Decision block 205 determines whether or not it received the above composed data. If, block 205 did not receive composed data then and in that event the program proceeds back to the input of block 205. If, block 205 determines that it did receive composed data then the program proceeds to block 210 to compose the buffer.

The flow chart that describes meter controller (FIG. 5) is shown in the right hand side of FIG. 8. Decision block 300 receives meter 52 data input from the data port of computer 50. Block 300 determines whether or not the postal value from the data port of computer 50 was received. If, the postal value was not received, then the program goes back to the input of block 300. If, block 300 determines that the postal value was received from computer 50 then the program goes to block 301 to perform the set meter process. At this point the program goes to block 302 to compute the indicia data field values. Then, the program proceeds to block 303. In block 303 an "acknowledgment 1" is sent to block 202 of the mail services program via the data port of computer 50. Then, the program goes to block 304 to extract and transfer the indicia unique number data field, i.e., security code 19. Security code 19 is then transmitted to the data port of computer 50.

FIG. 9 is a flow chart showing how information is being transferred to and from ram card 58 to produce graphics. The service graphics from the buffer to meter ram card 58 is read and transferred from block 134 via line 150 to ram card 58. The output from block 153 is transmitted to meter ram card 58 via line 154. The output from ram card 58 is transmitted to the input of decision block 152 via line 151. Decision block 152 determines whether or not the end of print signal is present. If, the end of print signal is not present, then the program goes back to the input of block 152. If, block 152 decides that the end of print signal is present, then the program goes to block 153 to clear the current image from ram card 58. The foregoing clear signal is transmitted to ram card 58 via line 154.

Meter controller 57 program receives an input from meter 52, the print command. Decision block 320 receives at its input the print command. Decision block 320 determines whether or not meter 52 is ready to print. If, meter 52 is not ready to print then the program goes back to the input of block 320. If, block 320 decides that meter 52 is ready to print then the program goes to block 321 to begin the standard print indicia process. Then the program goes to block 322 to read the special service graphic fields and print the information that is read in block 322 is the read and transfer graphics from buffers to meter ram card that was determined in block 134. This information is transmitted from ram card 58 to block 322 via line 316. The information from block 322 is also transmitted back to card 58 via line 316. Now the program goes to block 323 to read the user graphics field and print. The user graphics field and print is transmitted from card 58 to block 323 via connector 315 and line 317. Then the program goes to block 324 end-of-print signal from meter 52. The end-of-print signal is transmitted to ram card 58 via line 318 and the end of print signal to meter 52 is transmitted via line 319 to terminate the metering process.

Figure 10A:
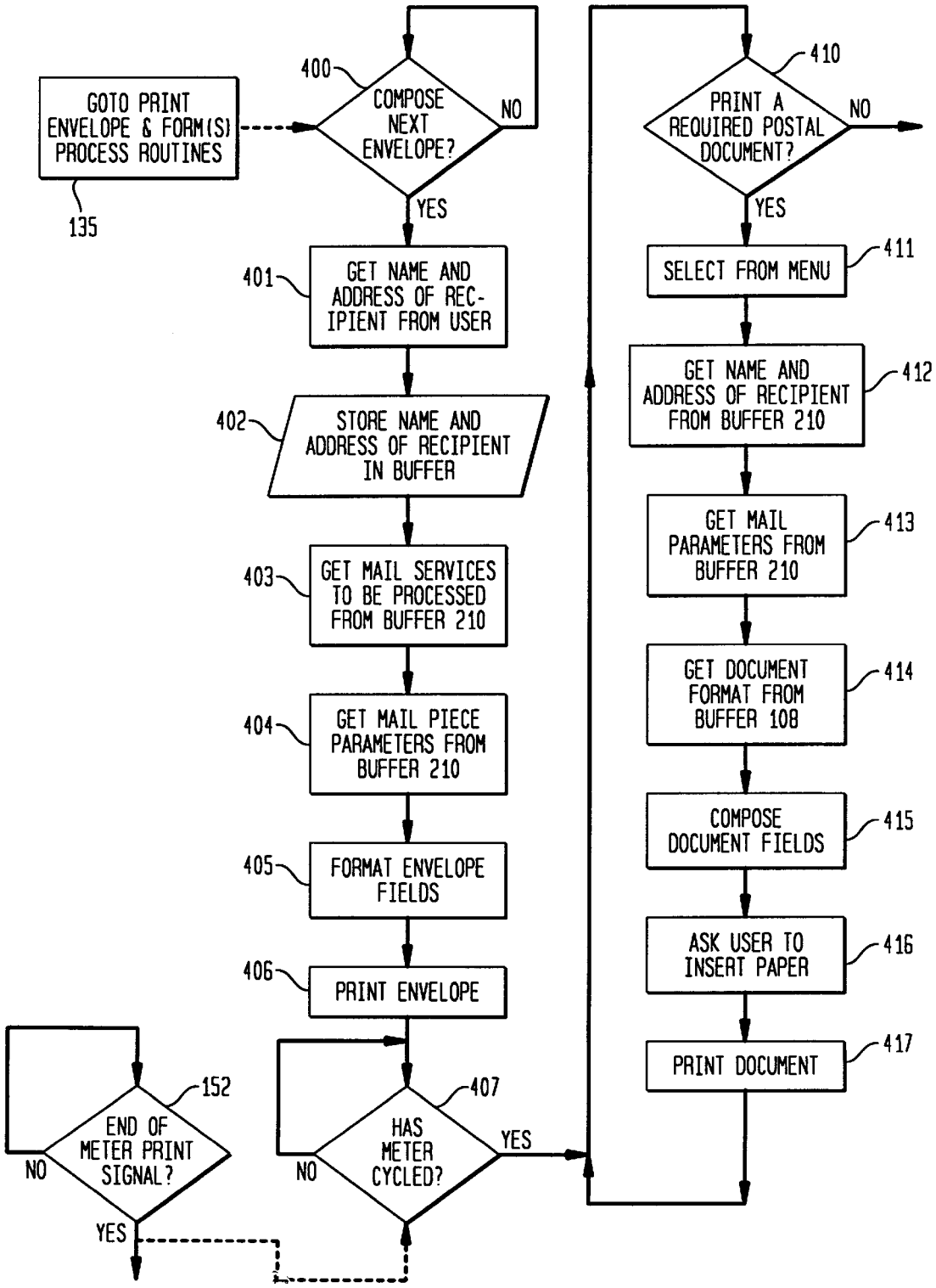
FIG. 10 is a flow chart showing the process for printing mail pieces and postal forms.
Figure 10B:
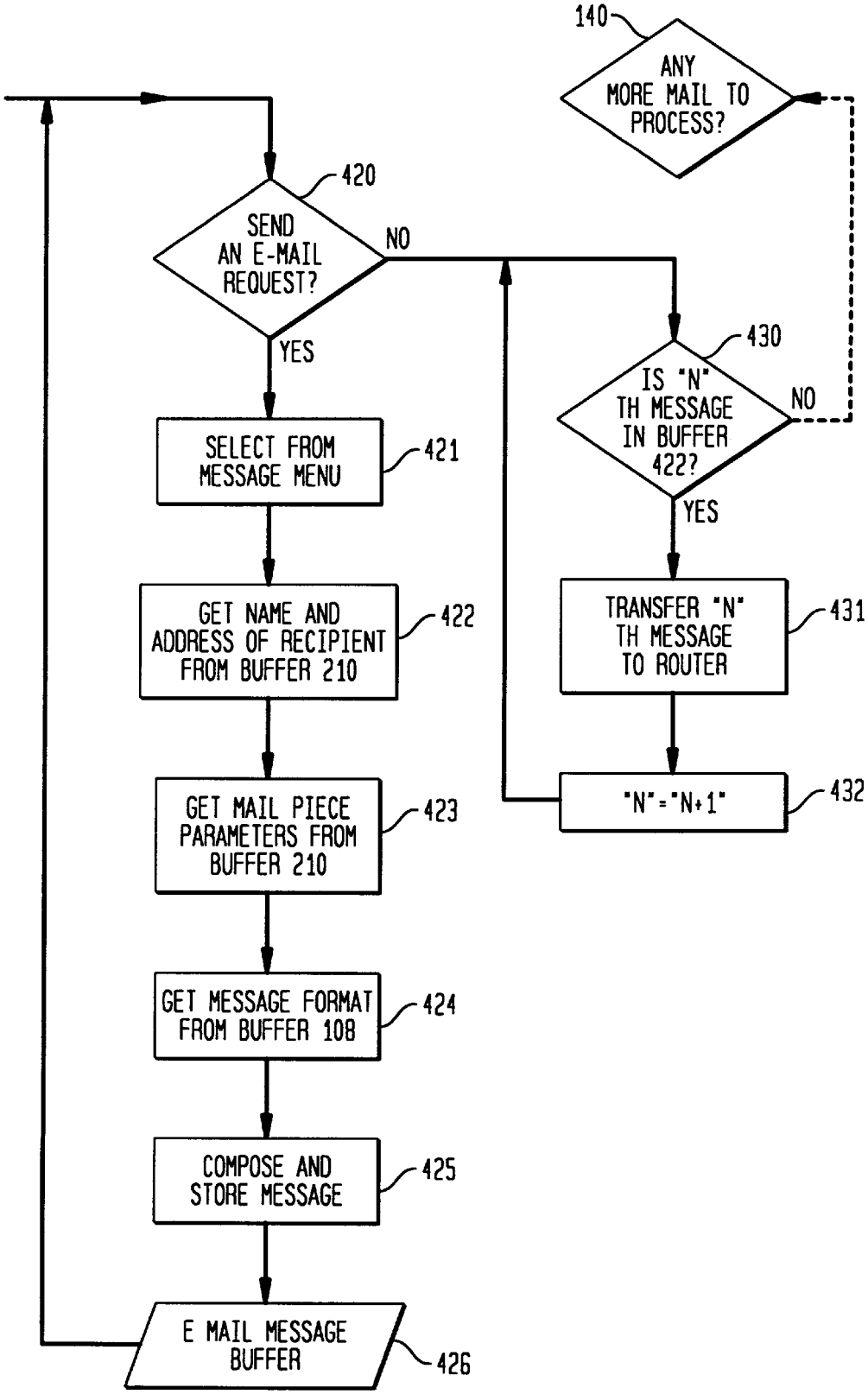

FIG. 10 is a flow chart showing the process for printing mail pieces and postal forms. This program begins in block 135 to print the mail piece and forms process routines. Then the program goes to decision block 400. Decision block 400 determines whether or not to compose the next envelope. If, the program is not ready to compose the next envelope or mail piece, then the program proceeds back to the input of decision block 400. If, the program is ready to print the next envelope or mail piece, then the program proceeds to block 401 to get the name and the address of the recipient from the user. Then the program goes to block 402 to store the name and address of the recipient in the buffer. Now the program goes to block 403 to obtain the mail services to be processed from buffer 210. Then the program goes to block 404 to get the mail piece parameters from buffer 210. At this point, the program goes to block 405 to format the envelope field. Then the program goes to block 406 to print the envelope. Now, the program goes to decision block 407. Decision block 407 determines whether or not meter 52 has cycled. The output of decision block 152 end of meter print cycle from FIG. 9 determines whether or not meter 52 has cycled. If, meter 52 has not cycled, then the program proceeds back to the input of block 407. If, meter 52 has cycled, then the program proceeds to decision block 410. Decision block 410 determines whether or not to print a required postal document. If, decision block 410 determines to print a required postal document, then the program goes to block 411 to select the proper document from the menu. Then the program goes to block 412 to obtain the name and address of the recipient from buffer 210. Then the program goes to block 413 to obtain the mail parameters from buffer 210. Now the program goes to block 414 to obtain the document format from buffer block 108 (FIG. 7). Then the program goes to block 415 to compose the document fields. Now the program goes to block 416 to ask the user to insert paper. Now the program goes to block 417 to print the document. After printing the document, the program proceeds back to the input of decision block 410.

If, decision block 410 determines that a required postal document should not be printed, then the program proceeds to the input of decision block 420. Decision block 420 determines whether or not to send an E-mail request. If, block 420 determines to send an E-mail request, then the program goes to block 421 to select this request from the message menu. Now the program goes to block 422 to get the name and address of the recipient from buffer 210. Then the program goes to block 423 to get the mail piece parameters from buffer 210. At this point, the program goes to block 424 to get the message format from buffer block 108 (FIG. 7). Now, the program goes to block 425 to compose and store the message. Then the program goes to block 426 to the E-mail message buffer and then proceeds back to the input of block 420.

If, block 420 determined not to send an E-mail request, then the program would proceed to decision block 430. Decision block 430 determines whether or not this is the nth message in buffer block 426. If, block 430 determines that it is the nth message in the buffer, then the program proceeds to block 431 to transfer the nth message to the router. Then the program goes to block 432 to determine whether N=N+1. Then the program goes back to the input of block 430.

If block 430 determines that the nth message is not present in the buffer, then the program proceeds to decision block 140 of FIG. 7.

FIG. 11 is a block diagram showing the other process services. The program begins in block 170. When block 170 receives an affirmative response from decision block 142 (FIG. 7) i.e. that there are other process services requested this subroutine begins. Block 170 displays the other services on the greeting screen of the display of computer 50. Then the program proceeds to decision block 171. Decision block 171 determines whether or not the user selected to refill meter 52. If, block 171 determines that the refill of meter 52 was requested then the program proceeds to block 440 to begin the meter refill routines. Then the program goes to block 441. If, block 441 determines that the refill process was not completed, the program goes to block 446 router and communication process routines and to modem 75 (FIG. 6).

If, block 441 determines that the refill process was completed, the program goes to block 172. If, block 171 determines that the user did not select to refill meter 52, then the program goes to decision block 172. Decision block 172 determines whether or not the user selected graphic registration service. The graphic registration service is a process whereby the user can submit a graphic to the center for registration. the center stores the graphic in a data base and acknowledges receipt of the graphics back to the user assigning it a unique number. If, the user selected graphic registration service, the program proceeds to block 442 to begin the user graphic registration process routines. Then the program goes to decision block 443 to determine whether or not the registration process is complete. If, block 443 determines that the registration process is not complete, the program goes to block 446 router and communication process routines and then to modem 73 (FIG. 6).

If, block 443 determines that the registration process is complete then the program goes to the input of block 173. If, block 172 determines that the user did not select a graphic registration service then the program proceeds to decision block 173. Decision block 173 determines whether or not the user selected the encoding option. The encoding option is a process whereby, code either in the form of alphanumerics, bar code or glyphs is added to the print format file buffer 108. If, block 173 determines that the user selected the encoding option, the program goes to block 444 to begin the user encoding process routines. Then the program goes to block 445 to determine whether or not the encoding process is complete. If, block 445 determines that the encoding process is not complete then the program goes to block 446 router and communication process routines and then to modem 75 (FIG. 6).

If, block 445 determines that the encoding process is complete then the program goes to the input of decision block 174. The program will also go to the input of block 174 if decision block 173 determines that the user did not select the encoding option. Decision block 174 determines whether or not the user is finished. If, block 174 determines that the user is finished the program goes to block 143. If block 174 determines that the user is not finished, the program goes back to the input of block 171.

Figure 12:
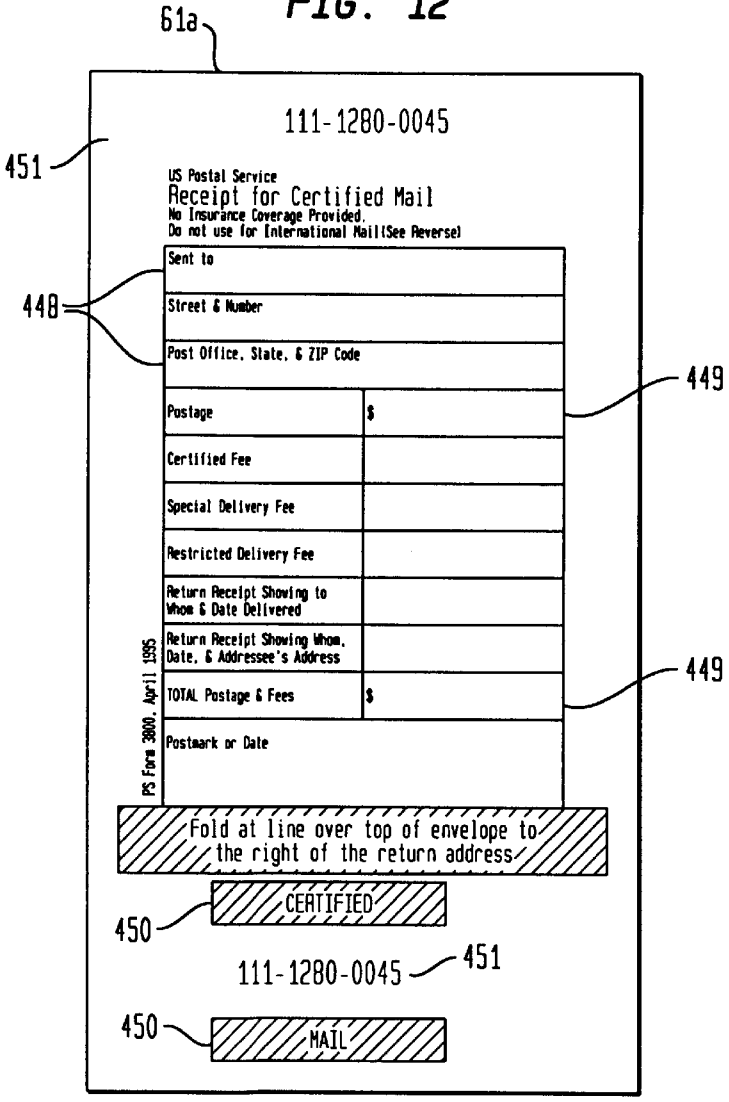
FIG. 12 is a drawing of a postal receipt for certified mail.

FIG. 12 is a drawing of a postal form, i.e., a postal receipt 61*a* for certified mail. Certified mail receipt 61*a* has spaces 448 where the recipient address field of mail piece 11 is printed and spaces 449 where the charges for the various postal services selected are printed and totaled. Receipt 61*a* also includes a certified mail indication 450 and a serial number 451. Serial number 451 may be derived from or equivalent to security code 19. It would be obvious to one skilled in the art that postal forms may be totally printed by the apparatus of this invention.

Figure 13:
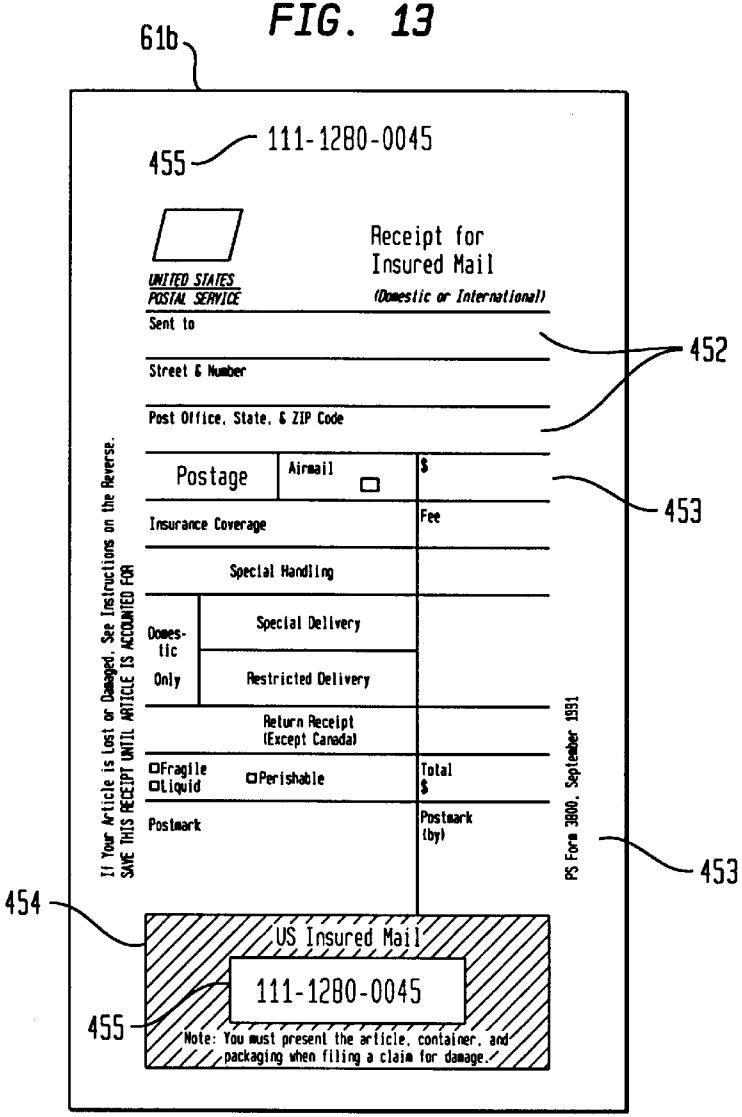
FIG. 13 is a drawing of a postal receipt for insured mail.

FIG. 13 is a drawing of a postal form, i.e., a postal receipt 61*b* for insured mail. Insured mail receipt 61*b* has spaces 452 where the recipient address field of mail piece 11 is printed and spaces 453 where the charges for the various postal services selected are printed and totaled. Receipt 61*b* also includes a insured mail indication 454 and a serial number 455. Serial number 455 may be derived from or equivalent to security code 19.

Figure 14:
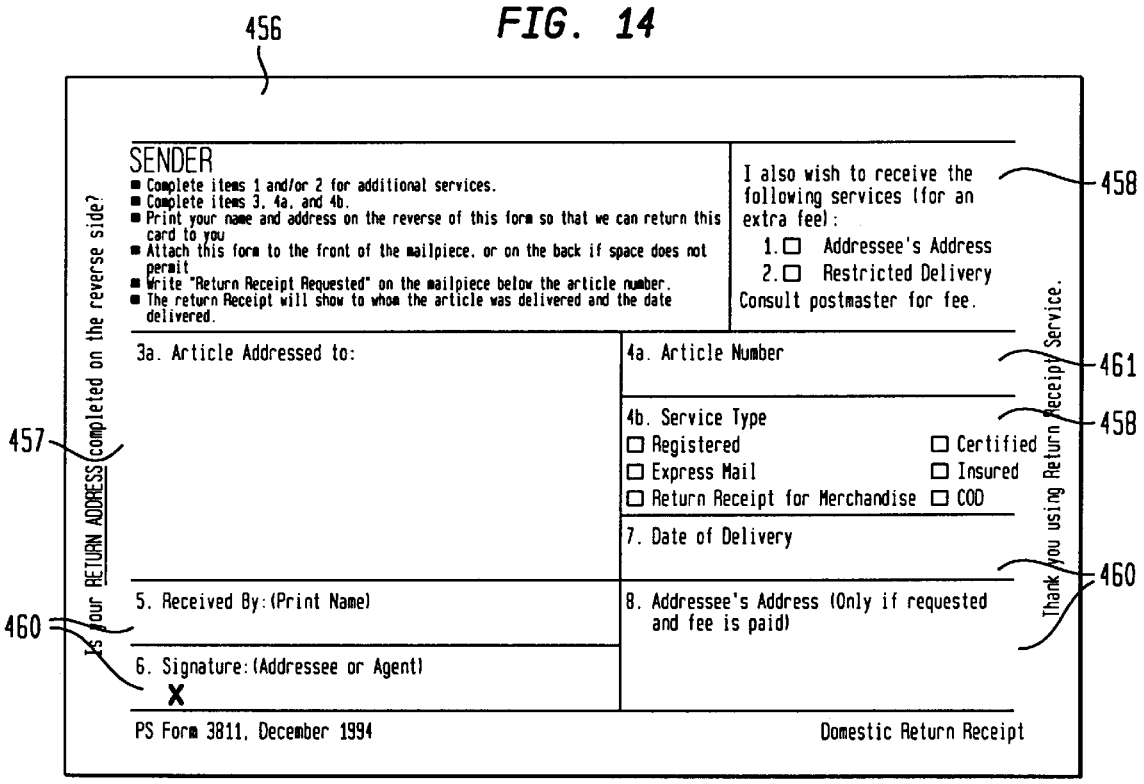
FIG. 14 is the front side of a return receipt card.

FIG. 14 is the front side of return receipt card 456. Return receipt card 456 has spaces 457 where the recipient address field of mail piece 11 is printed and spaces 458 where the various postal services selected are indicated. Spaces 460 are provided for the name and signature of the person who receives mail piece 11 as well as the date of delivery of mail piece 11. Card 456 also includes a article number or serial number 461. Serial number 461 may be derived from or equivalent to security code 19.

Figure 15:
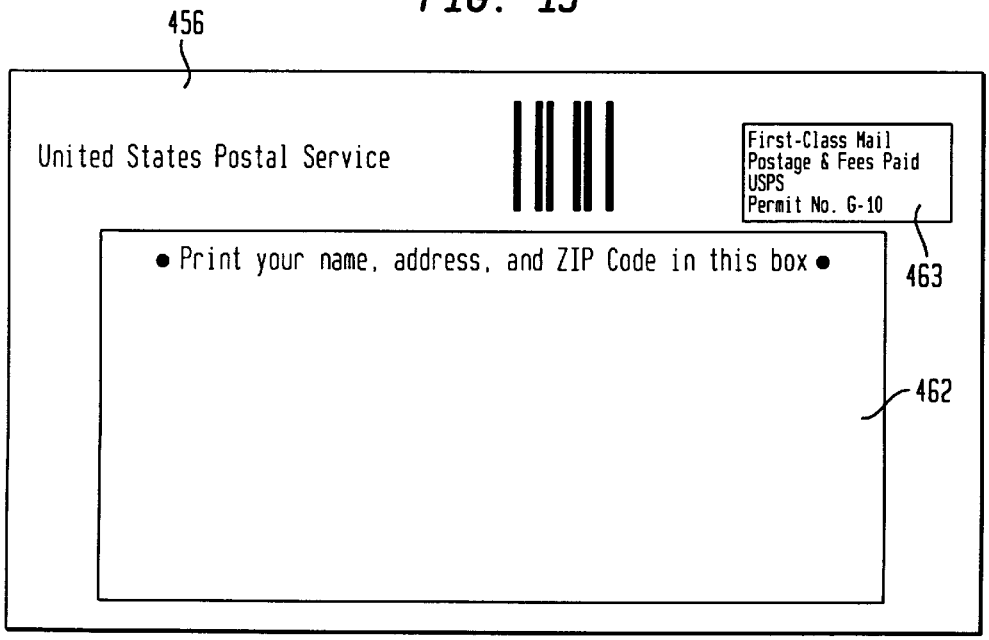
FIG. 15 is the back side of the return receipt card.

FIG. 15 is the back side of return receipt card 456. The back side of card 456 has a space 462 for sender address field 13 and an indication 463 that postage has been paid for card 456.

FIG. 16 is a flow chart of the Mail Services program contained within computer 71 of FIG. 6. The program begins in block 500 where the user selects the mail services program. Then the operating system of computer 71 loads the PSD mail services manager program in block 501. At this point the program proceeds to decision block 502 to determine whether or not PSD 74 (FIG. 6) is attached to computer 71. If, PSD 74 is not attached to personal computer 71, then the program goes to block 503 and ends the program. This information is sent back to the operating system of computer 71. If, the answer to the above question was yes, then the program proceeds to block 504 to read the software version for file. At this point the program goes to decision block 505 to determine whether or not the resident mailer service file is current. If, block 505 determines that the resident mailer service file is not current, then the program goes to block 506 to dial out to data center computer 78 (FIG. 6). Now the program goes to block 507 to download all the updated postal files. This is accomplished by obtaining from block 508 the current postal service graphic images, forms, rates, rules and fee files. Now, the program goes to block 509 to upload all user files. The user files are obtained from block 510, the files are the user mailer file of current mail piece graphics (public domain and registered). If, decision block 505 determines that the resident mailer service file is current, then the program proceeds to block 511 to set item counter J=1. The program will also proceed to block 511 after uploading all the user files from block 509.

At this point the program proceeds to block 512 to display the mail metering services greetings on the display of computer 71. Then the program proceeds to decision block 513 to determine whether or not the user has selected a specified service level from the display, i.e., first class mail, second class mail, third class mail, etc. If, the user has not selected a service level then the program goes back to the input of block 513. If, the user has selected a service level then the program proceeds to block 518 to capture and store the selected parameter in program "B buffer". The program will also go to decision block 514 to determine whether or not the weight of the mail piece was set. If, the weight of the mail piece was not set then the program proceeds back to the input of block 514. If, block 514 determines that the weight of the mail piece was set, then the program goes to block 518 to capture and store the selected weight in program "B buffer". The program also goes to decision block 515. Decision block 515 determines whether or not the select zone for the mail piece has been selected. If, the zone has not been selected then the program goes back to the input of block 515. If, the zone has been selected then the program goes to block 518 to capture and store the selected zone parameter in program "B buffer" and to the input of decision block 516. Decision block 516 determines whether or not any special mail services are needed. If, no special services are needed then the program goes to block 517 and then to block 530 to display the metering services production screen on the display of computer 71. If, block 516 determines that special services are needed then the program goes to block 521 to display the postal special services on the greeting screen of the display of computer 71. The stored parameters in block 518 are transmitted to block 520 to select the basic services parameter buffer register.

At this point the program proceeds to decision block 522 to determine whether or not the first service has been selected from the menu on the screen of computer 71. The following are some of the services that may be selected: FIM; expedited delivery; trace and track; return receipt requested; insurance; international mail; expedited international; certified mail; registered mail, etc. If, decision block 522 determines that the first service listed in the menu was not selected then the program goes back to the input of decision block 522. If, decision block 522 determines that the first service on the menu was selected then the program proceeds to block 525 to store the selected parameter value in buffer memory. Then the program goes to block 526 to select the special services parameter buffer register. The program will also proceed to the input of decision block 523. Block 523 determines whether or not the second selected special service was selected. If, the second service was not selected then the program proceeds back to the input of block 523. If, the second special service was selected then the program goes to block 525 to store the selected parameter value in the buffer memory and to block 526 to select the special services parameter buffer register. The program will proceed through a decision block for all of the services that were offered (not shown). At this point the program will proceed to decision block 524. Block 524 determines whether or not the last special service listed in the menu has been selected. If, block 524 determines that the last service on the list has not been selected then the program goes back to the input of block 524. If, block 524 determines that the last special service has been selected then the program goes to block 525. When the program finishes block 525 it goes to block 527 to copy the associated service graphics into the graphics buffer. Then the program goes to block 528 to special services graphic image buffer. These function will be at the outputs of blocks 522, 523, and 524. If, the output to block 524 is yes then the program goes to store the selected parameter value in buffer memory in block 525, to copy the associated service graphics into graphic buffer in block 527 and to the special services graphic image buffer in block 528. The program will also go to block 526 to select the special services parameter buffer register. The program will also go to block 530 to display metering services on the production screen of computer 71. Then the program proceeds to block 531 to sequentially read the information contained in block 520 namely the selected basic services parameter buffer register, use rates and fees to compose the basic postage value. Now the program goes to block 532 to sequentially read from block 526 the selected special services parameter buffer register use rates and fees to compute the special postage value. Then, the program goes to block 533 to sum block 531 and block 532. The sum of block 531 and 532 will be sent by block 533 to block 600 (FIG. 17) to obtain the postal value settings of PSD 74, i.e., to determine how much postage should be placed on the mail piece. Block 533 will also compose the image process and transfer this to decision block 605 (FIG. 17).

Then the program goes to block 534 to read and transfer service graphics from the buffer to PSD 74 print buffer (FIG. 6). Then the program goes to block 535 to print mail pieces and forms. At this point the program goes to decision block 540. Decision block 540 determines whether or not any additional mail is to be processed. If additional mail is to be processed then the program goes to block 541 and then to block 511. If, decision block 540 determines that there are no more mail pieces to process then the program goes to decision block 542. Decision block 542 determines whether or not any other process services are requested. If block 542 determines that no other process services are requested, then the program goes to block 543 and then proceeds to block 503 to end the program. If, block 542 determines that there are other process services that were requested then the program proceeds to (FIG. 20) to determine if there are other process services that the user wants to affix, i.e., do you have any graphics to register with computers 78 and 81.

Figure 17:
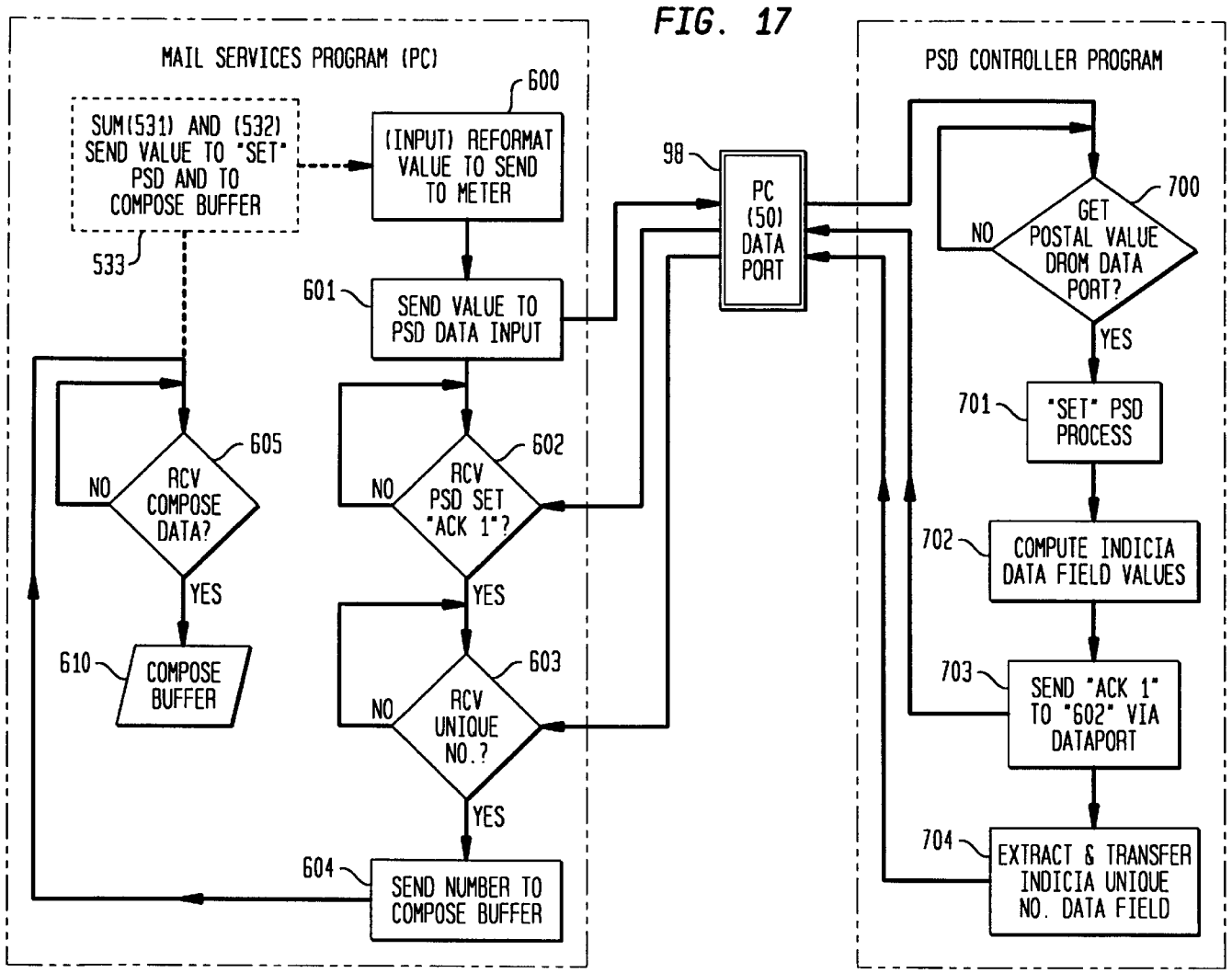
FIG. 17 is a flow chart of a program showing the interaction of the Mail Services Program with the PSD Controller Program to produce the indicia unique number, i.e. security code 19.

FIG. 17 is a flow chart of a program showing the interaction of the Mail Services Program with the PSD Controller Program to produce the indicia unique number, i.e. security code 19. After completing the function described in block 533 (FIG. 7) the program goes to block 600 to reformat the value that is going to be sent to PSD 74 (FIG. 6). Then, the program goes to block 601 to send the above value to the port of PSD 74 (FIG. 6) and then the program precedes to decision block 602. Decision block 602 determines whether or not PSD 74 received a PSD set acknowledgment from computer 71. If, block 702 determines that no "acknowledgment 1" was received, then the program goes back to the input of block 702. If, block 702 determines that PSD 74 received an "acknowledgment 1" from computer 71, then the program proceeds to decision block 603. Decision block 603 determines whether or not PSD 74 received a unique number (security code 19) from computer 71. If, block 603 determines that security code 19 was not received, then the program goes back to the input of block 603. If, block 603 determines that security code 19 was received, then the program goes to block 604. Block 604 sends security code 19 to decision block 605.

Decision block 605 receives the security code 19 from composed buffer block 604 and the sum 531 and 532 from block 533. Decision block 605 determines whether or not it received the above composed data. If, block 605 did not receive composed data then and in that event the program proceeds back to the input of block 605. If, block 605 determines that it did receive composed data then the program proceeds to block 610 to compose the buffer.

The flow chart that describes PSD controller program is shown in the right hand side of FIG. 17. Decision block 700 receives PSD 74 data inputs from computer 71. Block 700 determines whether or not the postal value from computer 71 was received. If, the postal value was not received, then the program goes back to the input of block 700. If, block 700 determines that the postal value was received from computer 71 then the program goes to block 701 to set the PSD process. At this point the program goes to block 702 to compute the indicia data field values. Then, the program proceeds to block 703. In block 703 an "acknowledgment 1" is sent to block 702 of the mail services program via computer 71. Then, the program goes to block 704 to extract and transfer the indicia unique number data field, i.e., security code 19. Security code 19 is then transmitted to computer 71.

Figure 18:
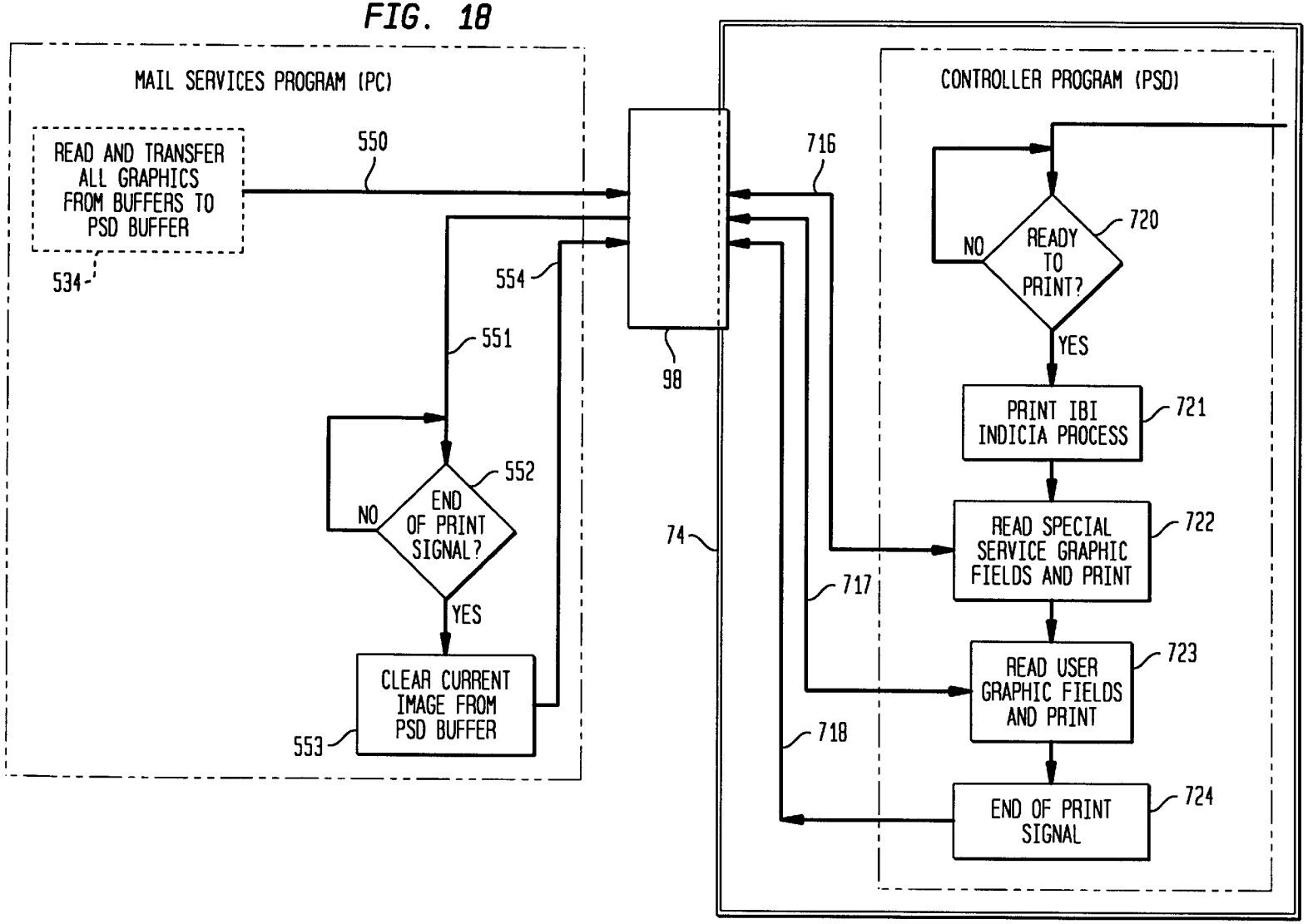
FIG. 18 is a flow chart showing how information is being transmitted to and from PSD 74 to produce graphics.

FIG. 18 is a flow chart showing how information is being transferred to and from PSD interface 98 to produce graphics. The service graphics from the buffer to PSD interface 98 buffer is read and transferred from block 534 via line 550 to PSD interface 98. The output from block 553 is transmitted to PSD interface 98 via line 554. The output from PSD interface 98 is transmitted to the input of decision block 552 via line 551. Decision block 552 determines whether or not the end of print signal is present. If, the end of print signal is not present, then the program goes back to the input of block 552. If, block 552 decides that the end of print signal is present, then the program goes to block 553 to clear the current image from PSD 74. The foregoing clear signal is transmitted to PSD interface 98 via line 554.

PSD controller program receives a print command from itself. This command is received when the controller determines that all the ready to print requirements are done. Decision block 720 receives at its input the print command. Decision block 720 determines whether or not computer 71 is ready to cause printer 72 to print (FIG. 6). If, printer 72 is not ready to print then the program goes back to the input of block 720. If, block 720 decides that printer 72 is ready to print then the program goes to block 721 to obtain the information based indicia 11 image from PSD 74. Then the program goes to block 722 to read the special service graphic fields and print the information that is read in block 722. This information is transmitted from PSD 74 to block 722 via line 716. The information from block 722 is also transmitted back to PSD interface 98 via line 716. Now the program goes to block 723 to read the user graphics print field. The user graphics print field is transmitted from PSD interface 98 to block 723 via line 717. Then the program goes to block 724 end of print signal from printer 72. The end of print signal is transmitted to PSD 74 via line 718 and the end of print signal to printer 72.

Figure 19A:
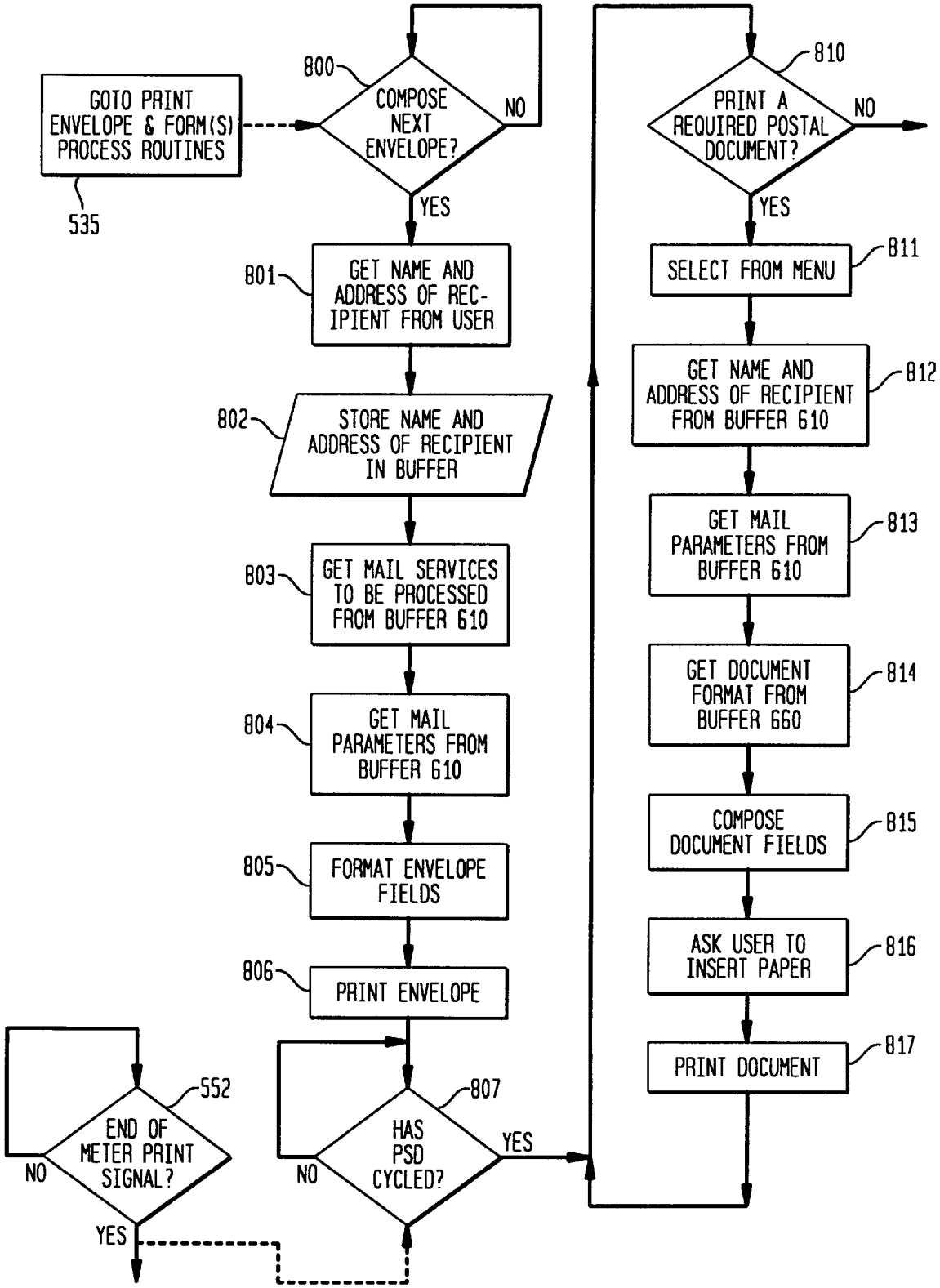
FIG. 19 is a flow chart showing the process for printing mail pieces and postal forms.
Figure 19B:
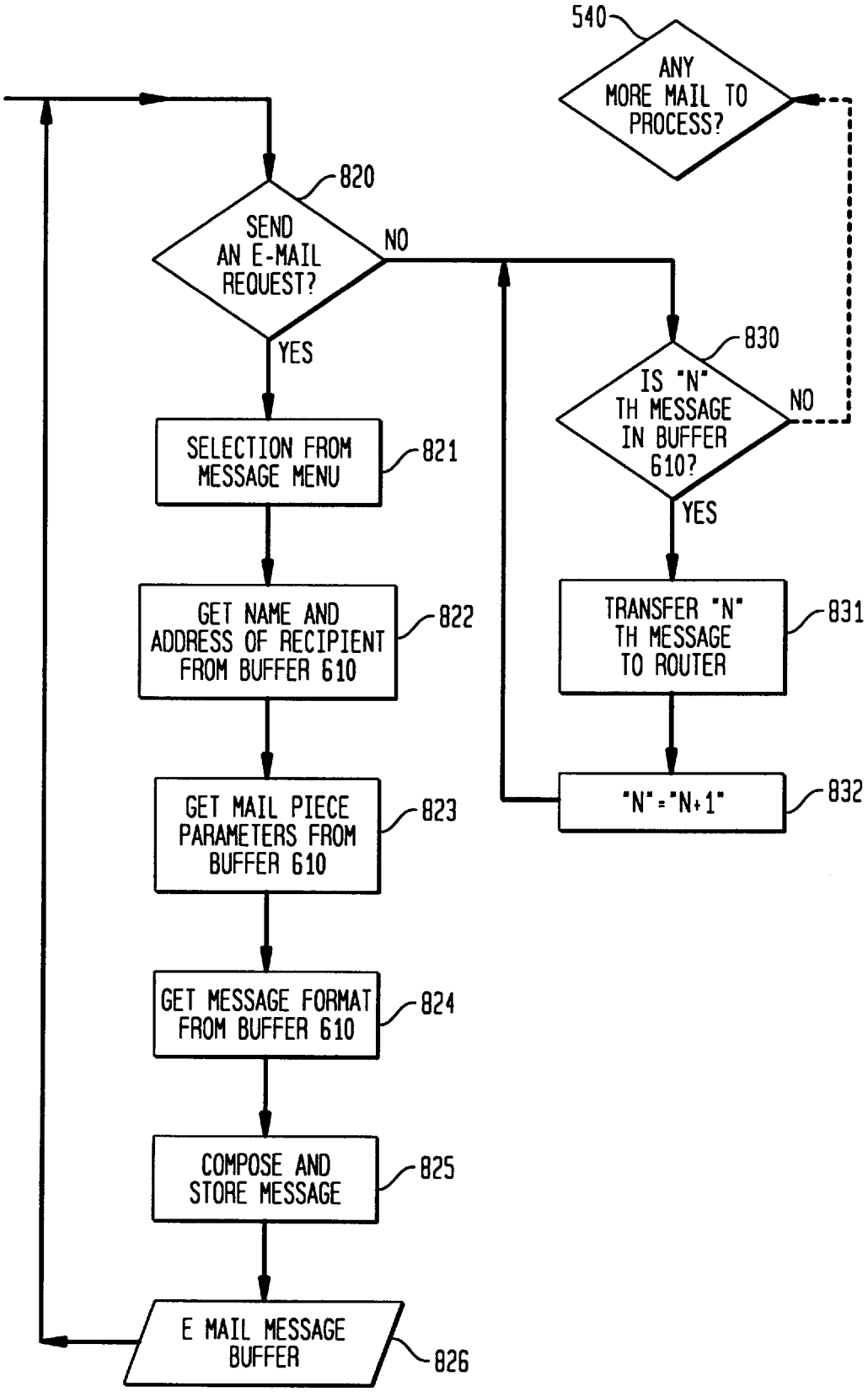

FIG. 19 is a flow chart showing the process for printing mail pieces and postal forms. This subroutine begins in block 535.

Then the program goes to decision block 800. Decision block 800 determines whether or not to compose the next envelope. If, the program is not ready to compose the next envelope or mail piece, then the program proceeds back to the input of decision block 800. If, the program is ready to print the next envelope or mail piece, then the program proceeds to block 801 to get the name and the address of the recipient from the user. Then the program goes to block 802 to store the name and address of the recipient in the buffer. Now the program goes to block 803 to obtain the mail services to be processed from buffer 610. Then the program goes to block 804 to get the mail piece parameters from buffer 610. At this point, the program goes to block 805 to format the envelope field. Then the program goes to block 806 to print the envelope. Now, the program goes to decision block 807. Decision block 807 determines whether or not PSD 74 has cycled. The output of decision block 552 end of meter print cycle from FIG. 16 determines whether or not PSD 74 has cycled. If, PSD 74 has not cycled, then the program proceeds back to the input of block 807. If, PSD 74 has cycled, then the program proceeds to decision block 810. Decision block 810 determines whether or not to print a required postal document. If, decision block 810 determines to print a required postal document, then the program goes to block 811 to select the proper document from the menu. Then the program goes to block 812 to obtain the name and address of the recipient from buffer 610. Then the program goes to block 813 to obtain the mail parameters from buffer 610. Now the program goes to block 814 to obtain the document format from buffer 610. Then the program goes to block 815 to compose the document fields. Now the program goes to block 816 to ask the user to insert paper. Now the program goes to block 817 to print the document. After printing the document, the program proceeds back to the input of decision block 810.

If, decision block 810 determines that a required postal document should not be printed, then the program proceeds to the input of decision block 820. Decision block 820 determines whether or not to send an E-mail request. If, block 820 determines to send an E-mail request, then the program goes to block 821 to select this request from the message menu. Now the program goes to block 822 to get the name and address of the recipient from buffer 610. Then the program goes to block 823 to get the mail piece parameters from buffer 610. At this point, the program goes to block 524 to get the message format from buffer 610. Now the program goes to block 825 to compose and store the message. Then the program goes to block 826 to the E-mail message buffer and then proceeds back to the input of block 820.

If, block 820 determined not to send an E-mail request, then the program would proceed to decision block 830. Decision block 830 determines whether or not this is the nth message in buffer 610. If, block 830 determines that it is the nth message in the buffer, then the program proceeds to block 831 to transfer the nth message to the router. Then the program goes to block 832 to determine whether N=N+1. Then the program goes back to the input of block 830.

If block 830 determines that the nth message is not present in the buffer, then the program proceeds to decision block 540 of FIG. 16.

FIG. 20 is a block diagram showing the other process services. The program begins in block 570. When block 570 receives an affirmative response from decision block 542 (FIG. 16) i.e. that there are other process services requested this subroutine begins. Block 570 displays the other services on the greeting screen of the display of computer 71. Then the program proceeds to decision block 571. Decision block 571 determines whether or not the user selected PSD 74 refill was requested. If, block 571 determines that the PSD refill was requested then the program proceeds to block 840 to refill the PSD. Then the program goes to block 841. If, block 841 determines that the refill process was not completed, the program goes to block 846 router and communications process routines.

If, block 841 determines that the refill process was completed, the program goes to block 572. If, block 571 determines that the user did not select PSD 74 refill, then the program goes to decision block 572. Decision block 572 determines whether or not the user selected graphic registration service. If, the user selected graphic registration service, the program proceeds to block 842 to begin the user graphic registration process routines. Then the program goes to decision block 843 to determine whether or not the registration process is complete. If, block 843 determines that the registration process is not complete then the program goes to block 846 router and communication process routines.

If, block 843 determines that the registration process is complete then the program goes to the input of block 573. If, block 572 determines that the user did not select a graphic registration service then the program proceeds to decision block 573. Decision block 573 determines whether or not the user selected the encoding option. If, block 573 determines that the user selected the encoding option, the program goes to block 844 to begin the user encoding process routines. Then the program goes to block 845 to determine whether or not the encoding process is complete. If, block 845 determines that the encoding process is not complete then the program goes to block 846 router and communication process routines.

If, block 845 determines that the encoding process is complete then the program goes to the input of decision block 574. The program will also go to the input of decision block 574 if decision block 573 determines that the user did not select the encoding option. Decision block 574 determines whether or not the user is finished. If, block 574 determines that the user is finished the program goes to block 575 and then to block 543 (FIG. 16).

If, block 574 determines that the user is not finished the program goes back to the input of decision block 571.

The above specification describes a new and improved system and method for providing a inexpensive and time saving way for reducing the use of gummed service stickers, providing postal specialty services and the completion by hand of special forms for specialty mail. It is realized that the above description may indicate to those skilled in the art additional ways in which the principles of this invention may be used without departing from the spirit. It is, therefore, intended that this invention be limited only by the scope of the appended claims.

What is claimed is:

1. An improved metering system that affixes an indicia to a mail piece, the improvement comprising:

recording information relative to an user selected post provided special service that is stored in a computer that recorded the indica on the mail piece that is unique to the mail piece in:

(a) the recorded requested special service, or (b) in the vicinity of the recorded requested service, where the recorded requested service is information contained in the indicia in the form of a code, wherein the requested service is recorded on the mail piece, and the current cost of the special service is maintained in the data center that is coupled to and transmits the cost to the computer and is accounted for by the metering system.

2. The system claimed in claim 1, wherein the requested service is recorded on a label that is affixed to the mail piece.

3. The system claimed in claim 1, further including: means for recording a slogan on the mail piece.

4. The system claimed in claim 1, wherein the metering system includes a postage meter that prints the indicia.

5. The system claimed in claim 1, wherein the metering system includes a personal computer, a postal security device that is coupled to the computer, and a printer that is coupled to the computer, wherein the printer prints the indicia.

6. The system claimed in claim 1 wherein the metering system includes a digital postage meter that prints the indicia.

7. The system claimed in claim 1, further including means for completing a postal form that may be attached to the mail piece.

8. The system claimed in claim 7, wherein said postal form is a return receipt requested card.

9. The system claimed in claim 1, further including means for completing a postal form that may be kept by the mailer.

10. The system claimed in claim 9, wherein said postal form is a insurance receipt.

11. The system claimed in claim 9, wherein said postal form is a certified mail receipt.

12. The system claimed in claim 1, wherein the code is obtained from information contained in the address field of the mail piece and information contained in the system used to print the indicia.

13. The system claimed in claim 12, wherein the recorded information about the requested service is recorded in a human readable code.

14. The system claimed in claim 12, wherein the recorded information about the requested service is recorded in a machine readable code.

15. The system claimed in claim 12, further including means for communicating the requested service to a post office data center.

16. The system claimed in claim 12, further including means for communicating the requested service to the data center.

17. The system claimed in claim 12, further including means for communicating the code to a post office data center.

18. The system claimed in claim 12, further including means for communicating the code to a data center of the manufacturer of the system that recorded the indicia on the mail piece.

* * * * *